US009032670B2

(12) United States Patent
Vogler et al.

(10) Patent No.: US 9,032,670 B2
(45) Date of Patent: May 19, 2015

(54) BLOW MOLDED MODULAR SHED

(71) Applicant: Suncast Technologies, LLC, Palm Beach Gardens, FL (US)

(72) Inventors: Michael R. Vogler, Oswego, IL (US); Michael Thuma, La Grange, IL (US); Torrence Anderson, Overland Park, KS (US); Brian C. Donnelly, Naperville, IL (US); Brian J. Russell, Aurora, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 14/214,270

(22) Filed: Mar. 14, 2014

(65) Prior Publication Data

US 2014/0283463 A1 Sep. 25, 2014

Related U.S. Application Data

(60) Provisional application No. 61/801,931, filed on Mar. 15, 2013, provisional application No. 61/801,723, filed on Mar. 15, 2013.

(51) Int. Cl.

| | |
|---|---|
| ***E04B 1/343*** | (2006.01) |
| ***E04H 5/00*** | (2006.01) |
| ***E04H 1/00*** | (2006.01) |
| *E04B 1/61* | (2006.01) |

(52) U.S. Cl.

CPC ..... *E04H 5/00* (2013.01); *E04B 1/34321* (2013.01); *E04B 1/34384* (2013.01); *E04H 1/005* (2013.01); *E04B 1/6137* (2013.01); *E04B 1/6141* (2013.01); *E04B 2001/6195* (2013.01)

(58) Field of Classification Search

CPC ..... E04H 1/1205; E04H 5/00; E04B 1/34321; E04B 1/3445; E04B 1/34315; E04B 1/344; E04B 1/6116; E04B 1/343; E04B 2001/6195; E04B 1/6141; E04B 1/6137

USPC ..... 52/79.1, 79.5, 79.9, 270, 271, 284

See application file for complete search history.

(56) References Cited

U.S. PATENT DOCUMENTS

| | | | | |
|---|---|---|---|---|
| 3,866,381 | A | 2/1975 | Eschbach et al. | |
| 4,557,091 | A | 12/1985 | Auer | |
| 5,036,634 | A | 8/1991 | Lessard et al. | |
| D371,208 | S | 6/1996 | De Zen | |
| 6,250,022 | B1 * | 6/2001 | Paz et al. | 52/79.5 |
| 6,701,678 | B1 * | 3/2004 | Skov et al. | 52/79.9 |
| 6,802,158 | B1 * | 10/2004 | Greene | 52/79.5 |
| 6,821,049 | B1 * | 11/2004 | Greene | 403/352 |
| 7,293,785 | B2 * | 11/2007 | Bush et al. | 280/47.34 |
| 7,543,411 | B2 * | 6/2009 | Whitehead et al. | 52/66 |
| 7,770,339 | B2 * | 8/2010 | Mower et al. | 52/93.2 |
| 7,877,936 | B2 * | 2/2011 | Uffner et al. | 52/90.1 |
| 8,020,347 | B2 * | 9/2011 | Mower et al. | 52/79.1 |
| 8,051,617 | B2 * | 11/2011 | Mower et al. | 52/311.1 |
| 8,069,820 | B2 * | 12/2011 | Anderson et al. | 119/498 |
| 8,511,001 | B2 * | 8/2013 | Uffner et al. | 52/66 |
| 8,650,807 | B2 * | 2/2014 | McKimmy et al. | 52/79.9 |
| 8,800,216 | B2 * | 8/2014 | Phillips et al. | 52/79.6 |
| 2004/0187400 | A1 * | 9/2004 | Anderson et al. | 52/79.1 |
| 2005/0210766 | A1 * | 9/2005 | Mower et al. | 52/79.5 |
| 2012/0110926 | A1 * | 5/2012 | Phillips et al. | 52/79.9 |

* cited by examiner

*Primary Examiner* — Adriana Figueroa
(74) *Attorney, Agent, or Firm* — McHale & Slavin P.A.

(57) ABSTRACT

The present invention provides for a system, or kit, of blow molded panels having integrally formed connectors which combine to form an enclosure, commonly in the form of a utility shed. The corner sections, roof, wall and floor panels are formed of blow molded plastic with integrally formed connectors to interlock with one another.

20 Claims, 25 Drawing Sheets

BLOW MOLDED MODULAR SHED

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Application No. 61/801,931, entitled, "Modular Blow Molded Shed", filed on Mar. 15, 2013; and to U.S. Provisional Application No. 61/801,723, entitled, "Blow Molded Modular Shed", filed on Mar. 15, 2013. The contents of which the above referenced applications are incorporated herein by reference in their entirety.

FIELD OF THE INVENTION

This invention relates generally to enclosed devices, such as utility or shed type enclosures constructed of plastic structural panels. More specifically, the present invention relates to a modular construction system utilizing blow molded plastic structural panels having integrally formed blow molded connectors to construct various sized enclosures using the same components.

BACKGROUND OF THE INVENTION

Utility sheds are a necessity for lawn and garden care, as well as general all-around home storage space. Typically, items such as garden tractors, snow blowers, tillers, ATVs, motorcycles and the like consume a great deal of the garage floor space available, forcing the homeowner to park his automobile outside.

The prior art has proposed a number of different panel systems, or kits, comprising blow molded or extruded panels and connector members for forming a wide variety of smaller sized storage structures. These structures are generally suitable to store hand tools and smaller lawn equipment. Typically, such systems require extruded metal or plastic connector members having a specific cross-sectional geometry that facilitate an engagement between such members and one or more blow molded plastic panels having a complimentary edge configuration. Due to the nature of the manufacturing process, blow molded plastic components typically cannot be formed with the intricate shapes and/or sharp corners required for integrated connectors.

A particularly common structure for the connector members is the I-beam cross section. The I-beam defines free edge portions of the connector member which fit within appropriately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel, and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process, the conduits are difficult to extrude in long sections for structural panels. Thus, they require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length; the protrusions being situated to slidably engage the conduits located in the side panel sections to create the height needed for utility shed walls.

The aforementioned systems can also incorporate roof and floor panels to form a freestanding enclosed structure such as a small utility shed. U.S. Pat. Nos. 3,866,381; 5,036,634; and 4,557,091 disclose various systems having inter-fitting panel and connector components. Such prior art systems, while working well, have not met all of the needs of consumers to provide the structural integrity required to construct larger sized structures. Larger structures must perform differently than small structures. Larger structures require constant ventilation in order to control moisture within the building. Large structures must also withstand increased wind and snow loads when compared to smaller structures. Paramount to achieving these needs is a panel system which eliminates the need for extruded connectors to create enclosure walls which resist panel separation, buckling, racking; and a roof system which allows ventilation while preventing weather infiltration. A further problem is that the wall formed by the panels must tie into the roof and floor in such a way as to unify the entire enclosure. Also, from a structural standpoint, the enclosure should include components capable of withstanding the increased wind, snow, and storage loads required by larger structures. From a convenience standpoint, a door must be present which can be easily installed after assembly of the wall and roof components, is compatible with the sidewalls, and which provides dependable pivoting door access to the enclosure. Also from a convenience standpoint, the structure should allow natural as well as artificial lighting. The structure should be aesthetically pleasing in appearance to blend in with surrounding structures.

There are also commercial considerations that must be satisfied by any viable enclosure system or kit; considerations which are not entirely satisfied by state of the art products. The enclosure must be formed of relatively few component parts that are inexpensive to manufacture by conventional techniques facilitated by the use of integrally formed connectors. The enclosure must also be capable of being packaged and shipped in a knocked-down state. In addition, the system must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using integrally formed connectors requiring minimal hardware and tools. Further, the system must not require excessive strength to assemble or include heavy component parts. Moreover, the system must assemble together in such a way so as not to detract from the internal storage volume of the resulting enclosure, or otherwise negatively affect the utility of the structure. Since the system is easily and quickly assembled using integrally formed connectors requiring minimal hardware and tools, as long as the structure's components are not damaged, the enclosure system can be disassembled and reassembled repeatedly as needed.

SUMMARY OF THE INVENTION

The present invention provides a system, or kit, of blow molded panels having integrally formed connectors which combine to form an enclosure, commonly in the form of a utility shed. The present invention describes a modular storage shed with roof support. The main structure is comprised of blow molded panels tied together with injection molded parts and metal components. While the enclosure described herein is a shed, other structures can be formed using the blow molded panels having integrally formed connectors.

The modular storage shed may contain molded connectors at the base of the main exterior wall panels which can be slid into mating receptacles in the floor panels. Each side, front, and rear panel has a mating receptacle in the perimeter of the corresponding floor location. Connectors on the bottoms of the wall panels slide in place into slotted openings in floor panel sections by inserting the molded connectors downward in the mating floor receptacle, then sliding the panel in the direction of the open slot. Once fully assembled, mating panels lock the enclosure in place about the floor. See FIGS. 8A-8D.

The modular resin storage shed may also contain molded connectors at the base of each corner panel, which are inserted into mating receptacle openings in the respective floor panel. Molded corner panels are positioned above the floor openings and male connectors are forced into position. Once installed, these features hold the correct angle and position for the corner panels. See FIGS. 9A-9D.

The modular storage shed may contain a molded header held in place about the shed by molded protruding connectors slid in mating receptacles contained within the connecting molded panels. The rear header contains multiple male connectors extending off the panel base into the top of the respective rear panel. The front molded header is held in place about the shed by molded protruding tabs slid into mating receptacle pockets contained within the front corner panels. See FIG. 10A-10C.

The modular storage shed may contain, at each corner, a panel having a male connector extending above the top of the panel which will align flush with the mating header once slid fully in place. Extended tabs align flush with the mating header, which has a molded ledge to prevent the panel from easily disconnecting. Once the panels are assembled, a metal beam and fasteners further hold this attachment in place. See FIG. 10. See FIGS. 10G-10I.

The modular storage shed may contain, at each wall panel, a specially designed overlap feature which acts to hold the panels together and form a water resistance for the shed interior. The overlap also acts to impede other foreign debris from entering the shed. The panel overlap at the easy bolt connection is designed to support a separate injection molded fastener. See FIGS. 11A-11B.

The modular storage shed may contain easy bolt connections at four wall panel overlap sections. The separate injection molded easy bolt connector is used to secure the mating panels. The easy bolt is inserted in the through opening portion of the panel overlap then tightened in the threaded portion of the mating panel. A positive water resistant seal is held consistent from the floor to the top of the blow molded panel by holding the panels with separate connector. See FIGS. 12A-12F.

The modular storage shed may contain, located at the front and rear upper portion of the header, a molded-in decorative vent that allows air passage throughout the shed. The vent serves both decorative and functional roles. Attached to the interior of each header panel is a mesh screen that is held in place by screws.

The modular storage shed may contain two frame truss systems located at the first third of shed and second third of shed along the length of the unit. Separate metal extruded beams are fastened together by bolts and nuts. A separate metal strap is installed to hold the specific roof angle. Metal brackets attach to molded details on the wall panels. At roof overlap, panels fit within the truss leg.

The modular storage shed may contain roof panels which are attached to the shed by laying roof panels in the truss leg channel on one end and snapped to the header at the other end. A water resistant overlap is formed at the peak of the unit. The overlap also impedes foreign debris from entering the shed and forms an even seam along the length of the shed roof.

The modular storage shed may contain ledges on the underside each roof panel allow the panel attached at the front and rear of the unit, interchangeably. Male protruding tabs on header panels attach to common ledges at specific locations. Roof panels are attached to header panels by first holding the roof panel at the correct angle, and then applying pressure at the overlapping ledge and protruding tab overlap.

The modular storage shed may contain metal door hinges attached to a shaft on the door panels and on an adjacent front panel. Metal hinges are inserted in the molded door pin notch then pivoted about the pins center. Once pivoted, the metal hinge will pivot about the door panel pin center. The flat section of the metal hinge slides over, matching geometry on the adjacent front panel. Molded pockets in the front panel allow bent flanges on the metal hinge to lock the parts together. The metal hinge is then further attached with a machine screw and hex bolt.

The modular resin storage shed may contain male protruding tabs at the top portion of wall panels along the sheds length. The wall panel male tabs overlap a molded ledge on roof panels. Screws are inserted through holes in the male protruding tabs into the molded ledge of each respective roof panel.

Accordingly, it is a primary objective of the present invention to provide a utility enclosure system which utilizes panel members having integrated connectors for creating enclosures of varying dimension using common components.

It is an objective of the instant invention to provide a modular resin storage shed with steel roof support.

It is a further objective of the instant invention to provide a modular resin storage shed with steel roof support, in which the main structure comprised of blow molded panels tied together with injection molded parts and metal components.

It is yet another objective of the instant invention resin storage shed with steel roof support having a modular design that allows for multiple assembly options and model upgrades.

It is a still further objective of the invention to provide a modular resin storage shed with steel roof support having side to floor connection method which is stronger than other blow molded snap down designs and greatly increases the force required to pull out the panel.

It is yet another objective of the instant invention to provide a modular resin storage shed with steel roof support having an aesthetically pleasing design.

It is a still further objective of the invention to provide a modular resin storage shed with steel roof support having a wide front door opening.

It is yet another objective of the instant invention to provide a modular resin storage shed with steel roof support having separate pieces comprising the vent system to allow air flow throughout shed.

It is yet another objective of the instant invention to provide a modular resin storage shed with steel roof support having injection molded panel connectors adapted to simplify assembly by reducing the amount of screws needed to assemble product.

It is a still further objective of the invention to provide a modular resin storage shed with steel roof support having articulating metal hinges to allow doors to open and close about an axis and eliminate large gaps at door edges.

It is a still further objective of the invention to provide a modular resin storage shed with steel roof support having unique attachments adapted to hold roof panels securely in place and allow for quick assembly.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
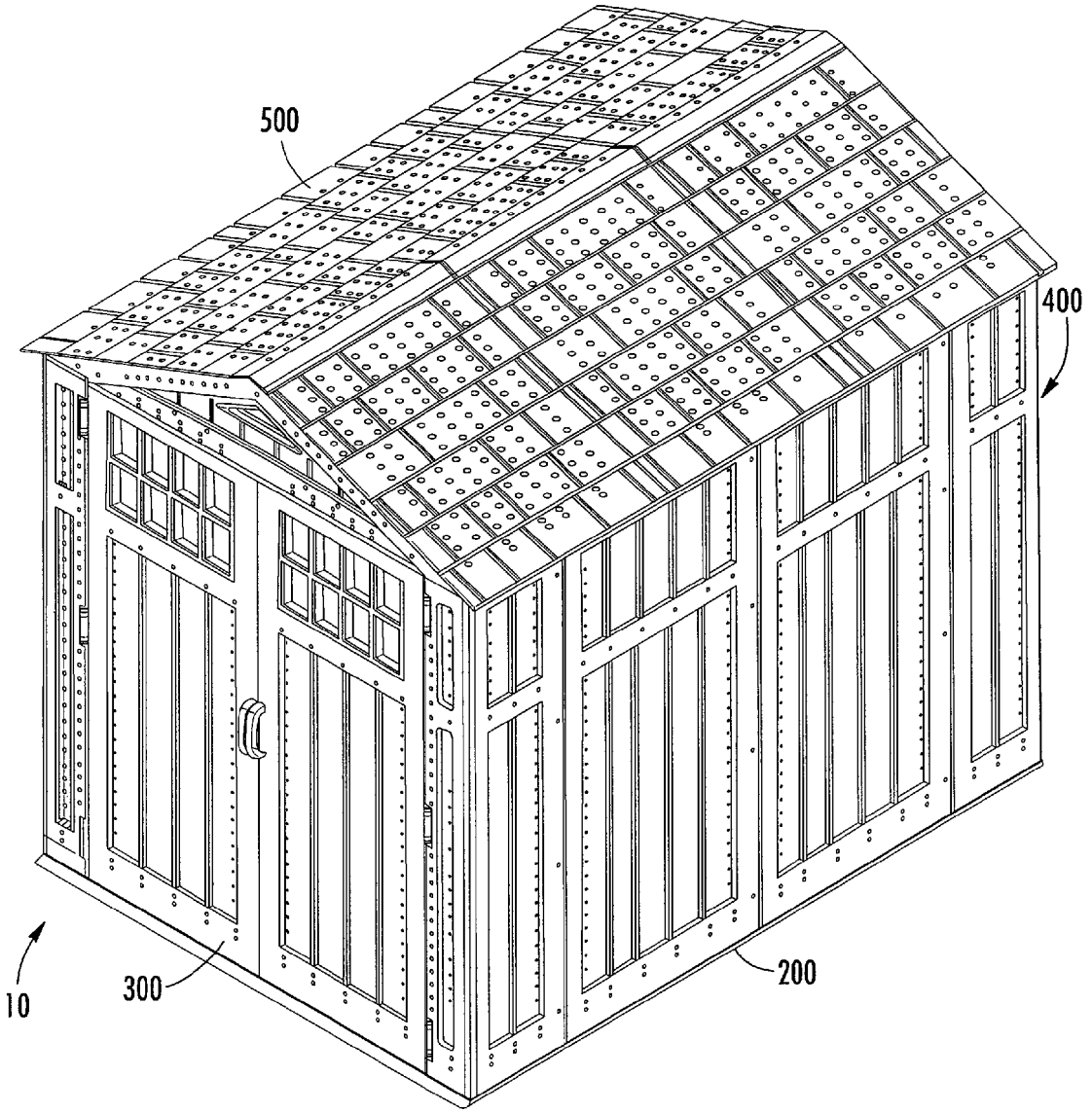
FIG. 1 is a perspective view of an illustrative example of a modular blow molded shed.
Figure 2:
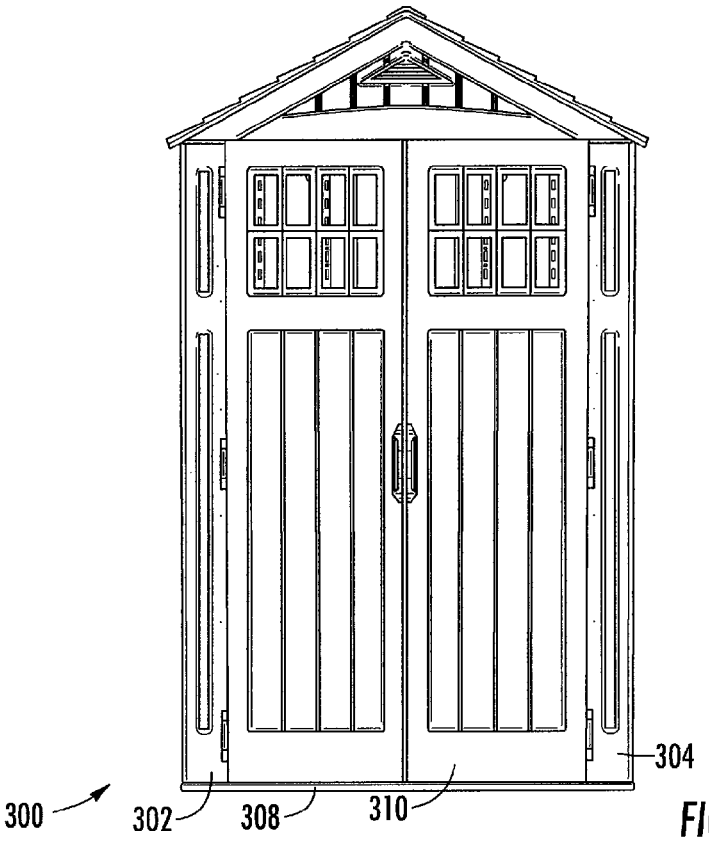
FIG. 2 is a front view of the modular blow molded shed illustrated in FIG. 1.
Figure 3:
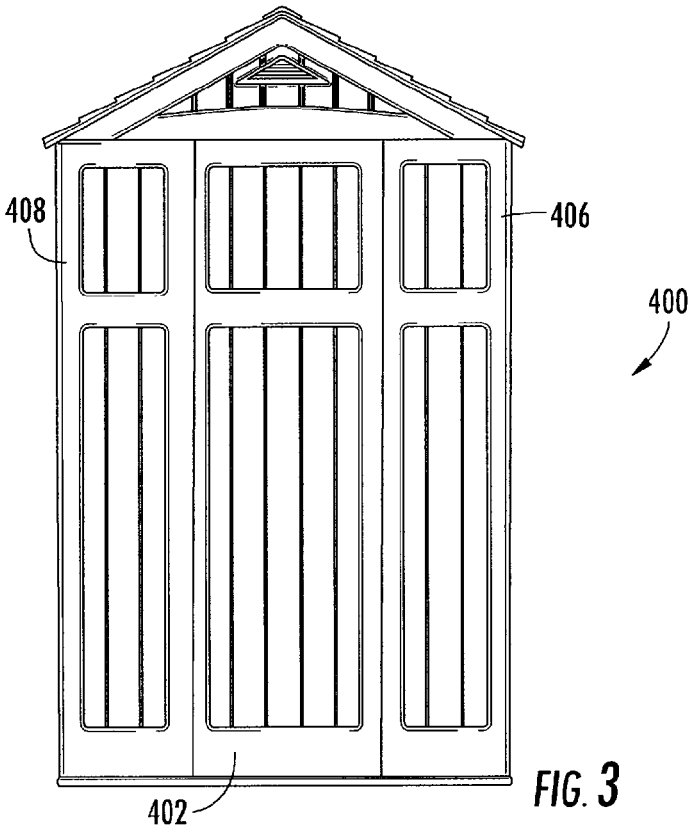
FIG. 3 is a rear view of the modular blow molded shed illustrated in FIG. 1.
Figure 4:
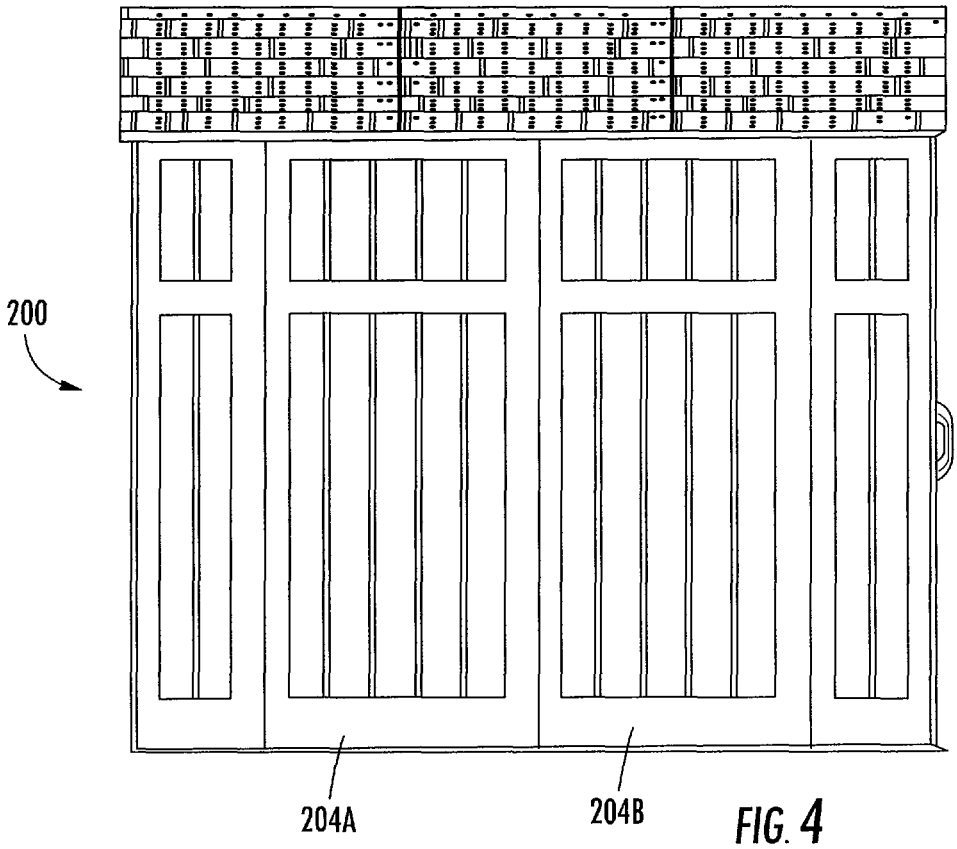
FIG. 4 is a side view of the modular blow molded shed illustrated in FIG. 1.
Figure 5:
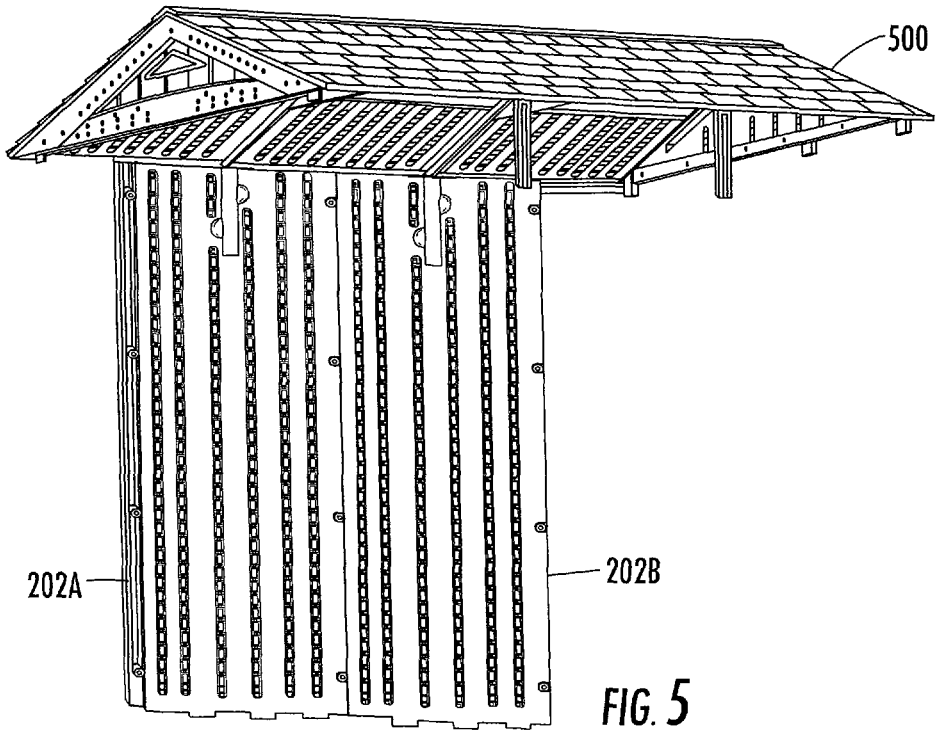
FIG. 5 is an interior roof view of the modular blow molded shed illustrated in FIG. 1.
Figure 6:
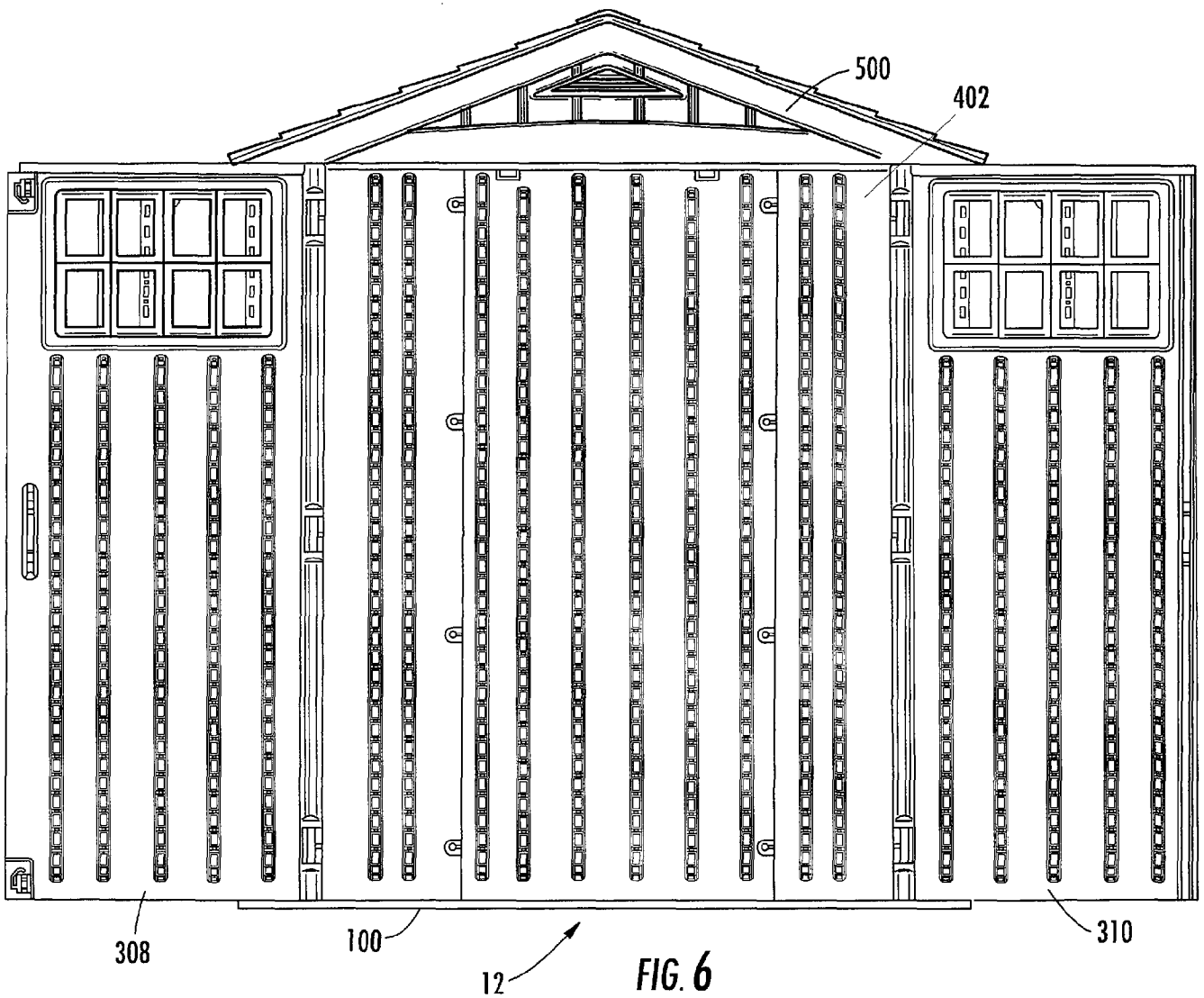
FIG. 6 is an interior view of the modular blow molded shed illustrated in FIG. 1.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

Referring to FIG. 1-6, a modular blow molded shed with steel roof support, referred to generally as modular blow molded shed 10, is illustrated. The modular blow molded shed 10 comprises a floor assembly 100, a side wall assembly 200, a front wall assembly 300, a rear wall assembly 400, and a roofing assembly 500. Each set of the panels are interconnected to form an enclosed structure having an interior 12. In a preferred embodiment, the panels comprising the assemblies are formed of, but not limited to, a suitable plastic such as polystyrene, polypropylene or polyethylene, through the process of blow molding. The result is that the panels comprising the floor assembly 100, side wall assembly 200, front wall assembly 300, a rear wall assembly 400, and a roofing assembly 500 of the modular blow molded shed 10 are formed as unitary panels with integral connectors. The panels comprising the assemblies are tied together through various connectors which are formed of, but not limited to, a suitable plastic such as polystyrene, polypropylene or polyethylene, through the process of injection molding. The roof support assembly may be made of steel components.

Figure 7A:
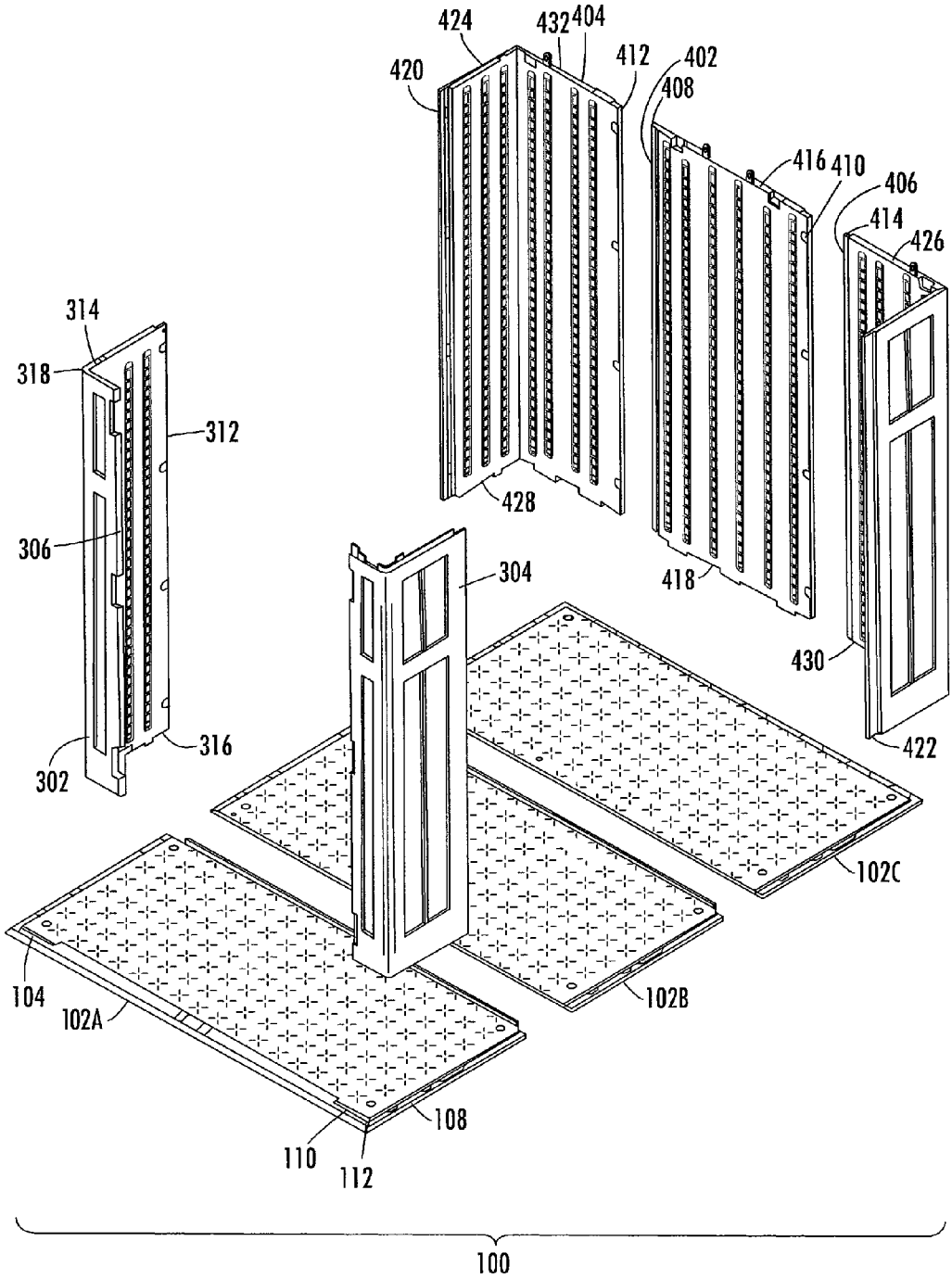
FIG. 7A is an exploded view of the modular blow molded shed of the present invention, having a two panel side wall assembly.
Figure 7B:
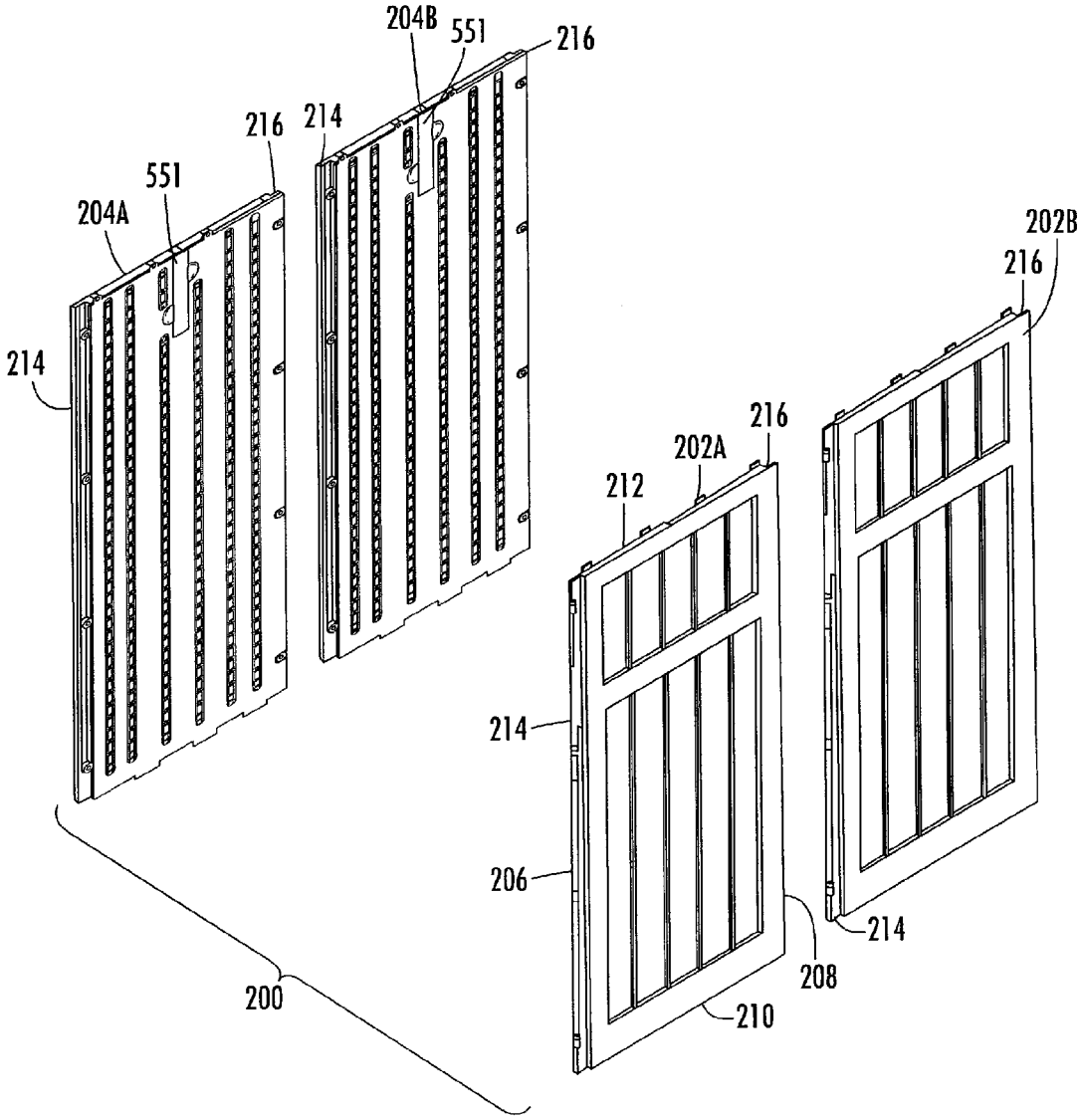
FIG. 7B illustrates the left and right side panels that define the side wall assembly.
Figure 7C:
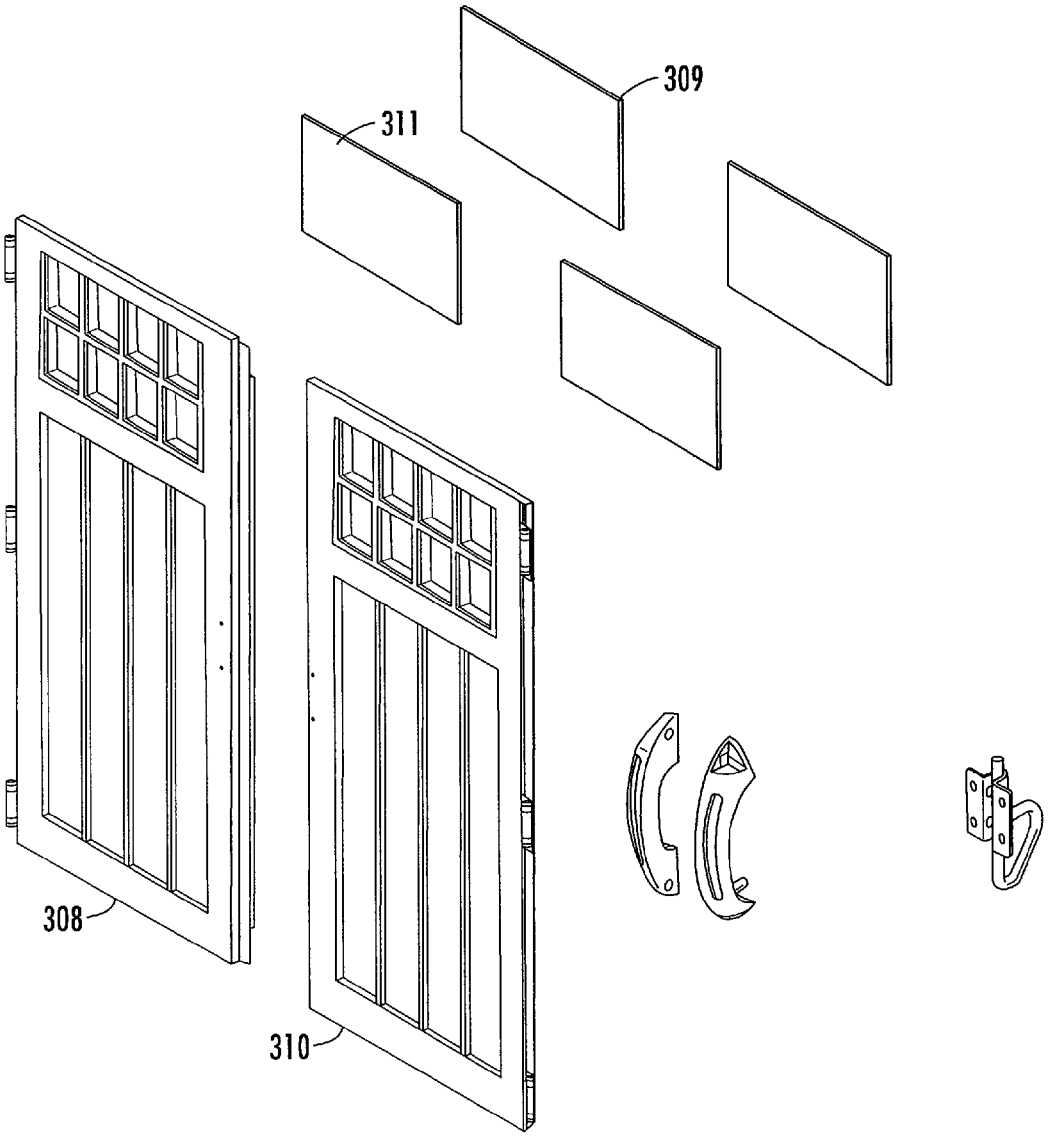
FIG. 7C is an exploded view of a door assembly.

Referring to FIGS. 7A, 7B, and 7C, the modular blow molded shed 10 includes a floor assembly 100 comprised of a plurality of like-constructed floor panels 102, shown as front floor panel 102A, mid floor panel 102B, and rear floor panel 102C. While the floor assembly 100 is shown having three panels, the use of three panels is illustrative only and could include as little as a single panel or more than three panels. Each floor panel is designed to secure to corresponding floor panel 102 and to members of the wall assemblies 200, front wall assembly 300, or rear wall assembly 400.

The side wall assembly 200 includes one or more like-constructed side wall panels. As illustrated in FIG. 7B, the side wall assembly 200 includes a first right side wall panel 202A and a second right side panel 202B. The first right side wall panel 202A is configured to couple or secure to second right side panel 202B and/or other components of the modular blow molded shed 10 along side edges 206 and 208, and to the floor assembly 100 and roof assembly 500 at the bottom edge 210 and a top edge 212. The side assembly also comprises of a first left side wall panel 204A and a second left side wall panel 204B. The first left side wall panel 204A is configured to couple or secure to the second left side wall panel 2028 and/or other components of the modular blow molded shed 10 along side edges 206 and 208, and to the floor assembly 100 and roof assembly 500 at the bottom edge 210 and a top edge 212. While the floor assembly 200 is shown having two panels per side, the use of two panels is illustrative only and could include as little as a single panel per side or more than two panels per side.

The front wall panel includes left side and right side front corner panels 302 and 304. Each panel contains a first side wedge 306 adapted to secure or couple to left door 308 or right door 310, with optional windows 309 secured using window gaskets 311, see FIG. 7C, a second side edge 312 adapted to secure or couple to a side wall panel 202A or 204A, a top side edge 314 adapted to secure or couple to a member of the roof assembly, and a bottom edge 316 adapted to secure or couple to a floor member panel 102. Each right front corner panel 302 and 304 contains a hinged edge 318 which allows for the corner panels to secure to two different portions or sides of the floor panel 102 which intersect at an angle (see for example sides 108 and 110 intersecting at right angle corner 112).

The rear wall assembly 400 includes one or more like-constructed rear wall panel 402, a left rear corner panel 404 and a right rear corner panel 406. The rear wall panel 402 comprises a pair of side edges 408 and 410 configured to secure or couple a left rear corner panel 404 side edge 412 to a right rear corner panel side edge 414. The rear wall panel 402 further comprising of a top edge 416 configured to secure to the roof assembly 500 and a bottom edge 418 configured to secure to a floor panel 102. Each corner panel 404 or 406 comprises an opposing side edge 420, 422 configured to secure or couple to side panels 204A or 204B. Each corner panel 404 or 406 also comprises a top edge 424 or 426 configured to secure to the roof assembly 500 and a bottom edge 418, 428 or 430 configured to secure to a floor panel 102. A hinged edge 432 allows for the corner panels to secure to two different portions or sides of the floor panel 102. While the rear wall assembly 400 is shown having one panel, the use of one panel is illustrative only and could include two or more panels if required.

Figure 8B:
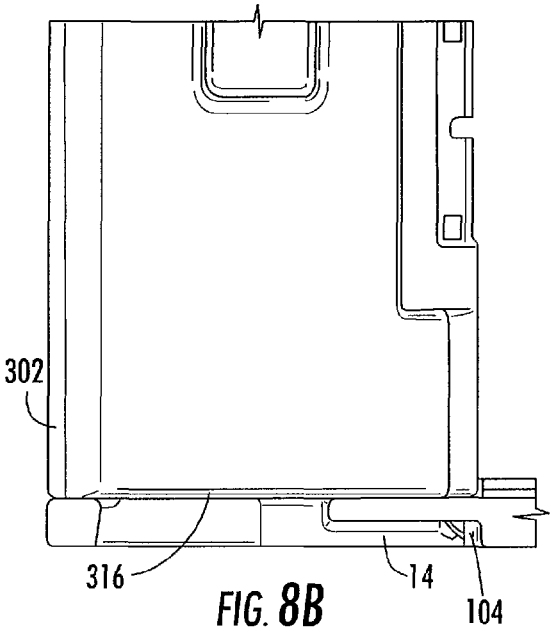
FIG. 8B is a section view of Box 8A in FIG. 8A, illustrating one type of floor connection.
Figure 8A:
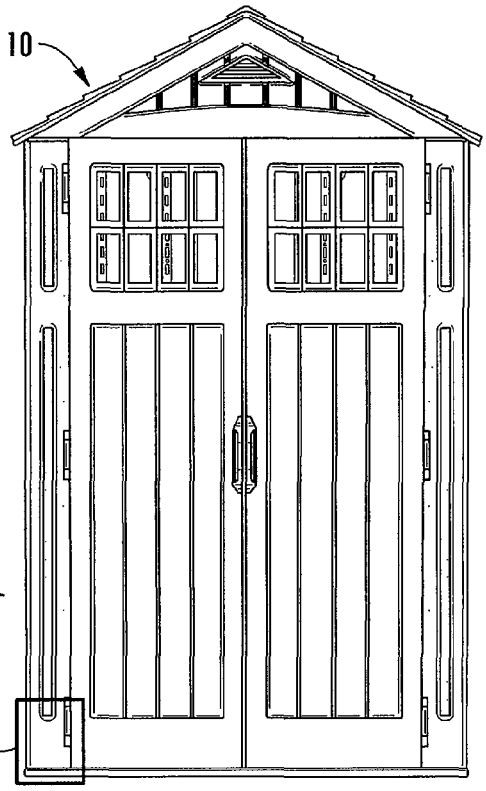
FIG. 8A is a front view of the front panel of the modular blow molded shed illustrated in FIG. 1 secured to a floor panel using an illustrative connector.

The modular blow molded shed 10 preferably contains one or more integrally formed connectors. In one embodiment, the modular blow molded shed 10 comprises of at least two different connector types. As such, the modular blow molded shed 10 comprises a first connector, illustrated herein as a molded foot connector 14, for connecting or securing panels to the floor panels 102, see FIGS. 8A-8D. The first connectors are positioned at, on, or extending from the bottom surfaces or edges 210, 316, 418, 428, 430 of the side walls 202, 204, corner panels 302, 304, rear wall panel 402, left rear corner panel 404 and/or the right rear corner panel 406. The foot connector 14 is configured to mate with a foot connector mating receptacle 104 having a connection slot located at or along a perimeter 106 of the floor panel 102. As illustrated in FIG. 8B, a foot connector 14 associated with the front corner panel 302 is engaged with foot connector mating receptacle 104. The foot connector 14 is slid into the mating receptacle 104 in the floor panels thereby securing the front corner panel 302 to the floor panel 102.

Figure 8C:
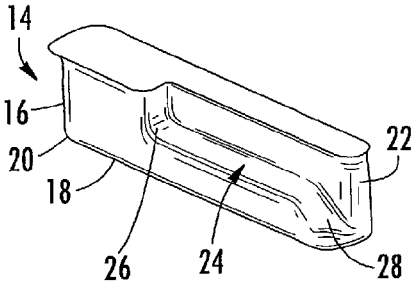
FIG. 8C is a perspective view of an illustrative embodiment of a foot connector.
Figure 8D:
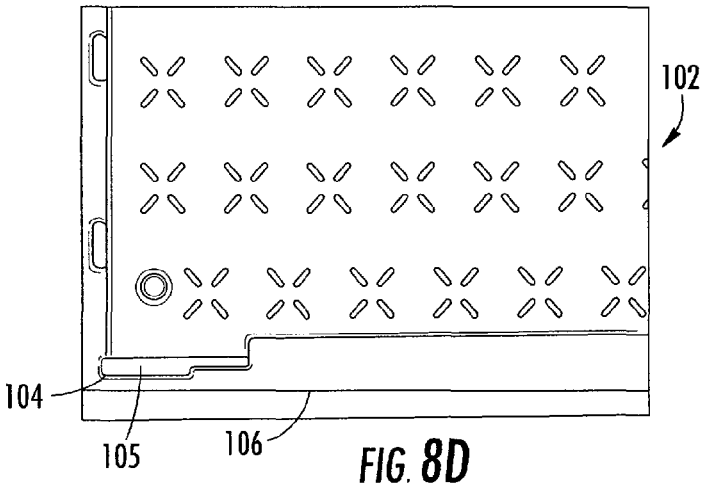
FIG. 8D is a partial view of the foot connector tab mating receptacle.

In an illustrative example, the foot connector 14 is designed to slidably cooperate with the foot connector mating receptacle 104 of the floor panel 102 and includes a top end 16, a bottom end 18, a left end 20 and a right end 22, an internal channel or cavity 24 defined by a partially curved edge 26 at one end and a ramping surface 28 at second end, see FIG. 8C. The left end 20 may be open, exposing the internal channel or cavity 24.

Accordingly, each side wall panel, front corner panel, rear wall panel, and rear corner panel has a foot connector mating receptacle 104 in the perimeter of the corresponding floor location. The foot connector 14 on the bottom of the panels slide in place into slotted openings 105 in floor panel sections by inserting the foot connector 14 downward in the mating floor receptacle 104, then sliding the panel in the direction of the open slot. Once fully assembled, the panels lock the structure in place about the floor.

Figure 9A:
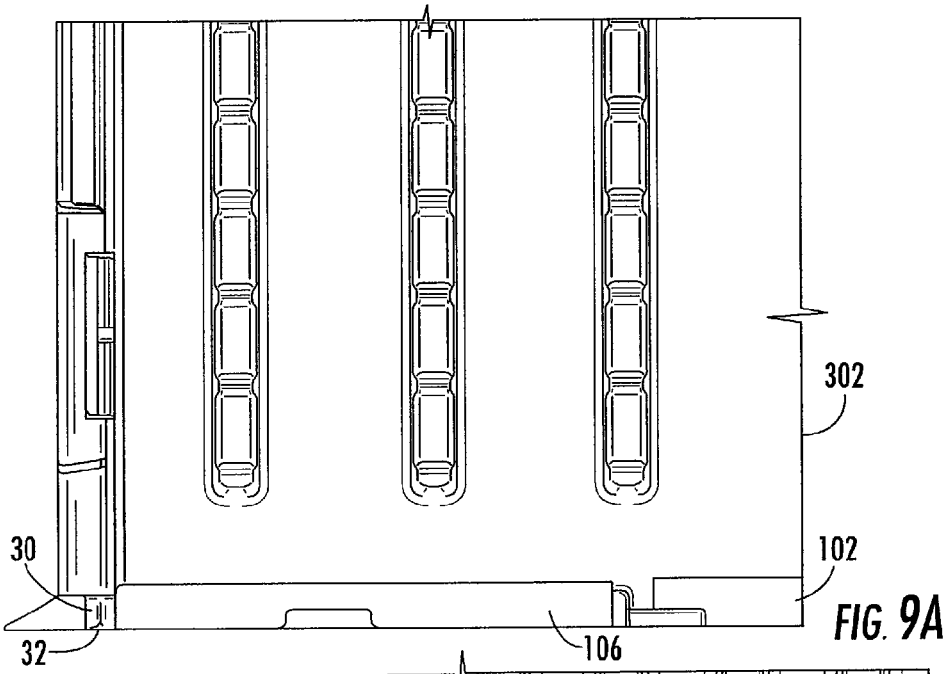
FIG. 9A illustrates an alternative connector, a snap connector, used to secure portions of the modular blow molded shed to the floor panel.
Figure 9B:
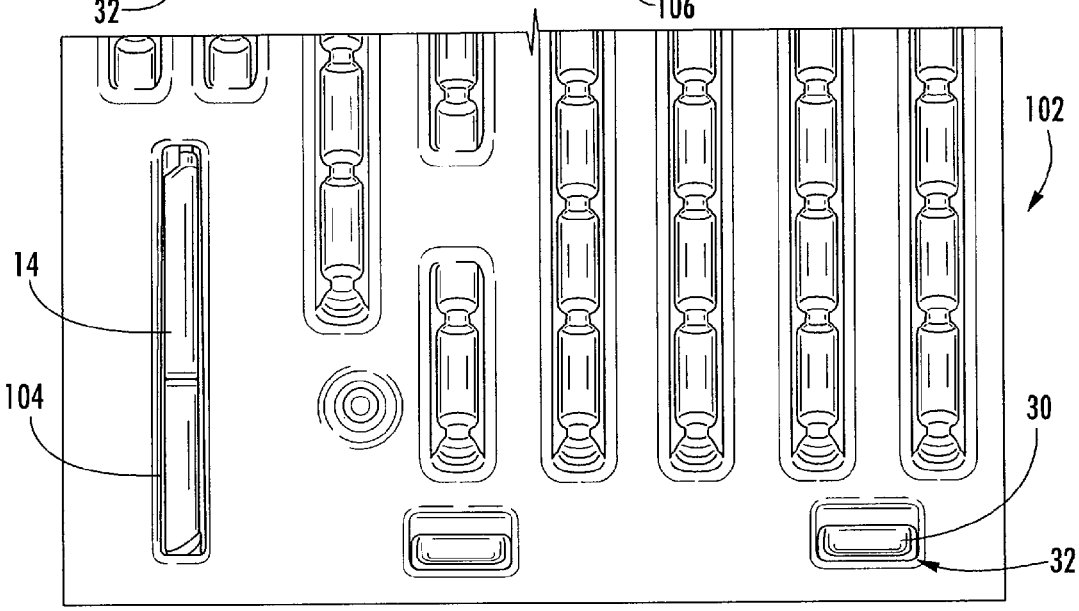
FIG. 9B illustrates the underside of the floor.

Referring to FIGS. 9A-9D, a second blow molded shed connector is shown. As shown in FIG. 9A, left side front corner panels 302 may contain, at the base of corner panel, one or more molded tabs, illustrated herein as a snap connector 30. The snap connector 30 is inserted into snap connector mating receptacle 32 in a respective floor panel 102. To provide a connection, the left side front corner panel 302 is positioned above the floor panel snap connector mating receptacle 32 and snap connector(s) 30 is/are forced into position. Once installed, these features hold the correct angle and position for the corner panels. While the snap connector 30 is illustrated for the left side front corner panels 302, each of the other corner panels, the right side front corner panels 304, the left rear corner panel 404, and the right rear corner panel 406 may contain such connectors.

Figure 9C:
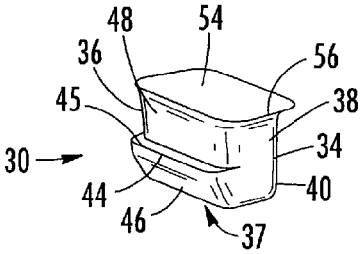
FIG. 9C illustrates a perspective view of a snap connector with ledge.

Referring to FIG. 9C, an illustrative embodiment of the snap connector 30 is shown. The connector contains a main body 34 which extends away from the side edges of a corner panel and is defined by a plurality of opposing side walls 36 and 38 and opposing side walls 40 and 42. Positioned within side wall 36 is flange 37 having a snap ledge 44 which forms a locking surface 45. Below the snap ledge 44 is an angled surface, illustrated as a first ramping surface 46 which allows the snap connector 30 ease of entry and guidance within the floor panel snap connector mating receptacle 32. The portion 48 of side wall 36 above the snap ledge 44 is set back, which provides for a J-shaped cross section, which allows for a secure fit within a corresponding area of the floor panel corner connector mating receptacle 32.

Figure 9D:
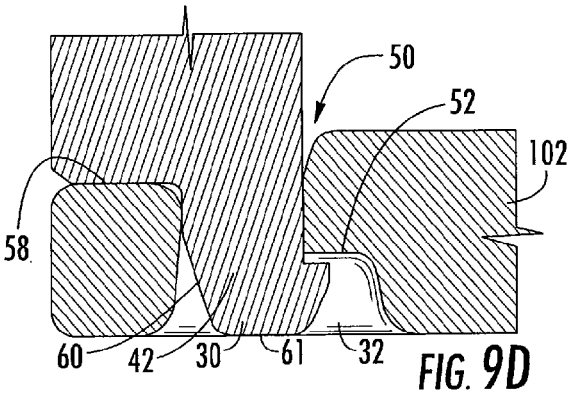
FIG. 9D illustrates a section view of a connection between the snap connector and the snap connector mating receptacle 32.

As illustrated in FIG. 9D, the floor panel corner connector mating receptacle 32 has an opening 50 sized and shaped to allow for entry of the snap connector 30. Once inserted, the snap ledge 44 abuts or secures to a corresponding shoulder 52 within the floor panel snap connector mating receptacle 32. To provide for a tight fit, the top portion 54 of the snap connector 30 may have an overhang 56 which rests upon the upper most surface 58 of the floor panel corner connector mating receptacle 32. A second angled surface or ramping surface 60 positioned on an opposing second wall, see FIG. 9D, may also aid in insertion and guidance within floor panel corner connector mating receptacle 32. As such, when the tip 61 of the snap connector 30 is inserted into snap connector mating receptacle 32, the ramping surfaces 46 and 60 apply a force thereupon and expand the snap connector mating receptacle opening, which closes upon the locking surface 45 once fully inserted, thereby locking the snap connector 32 in place.

Figure 7D:
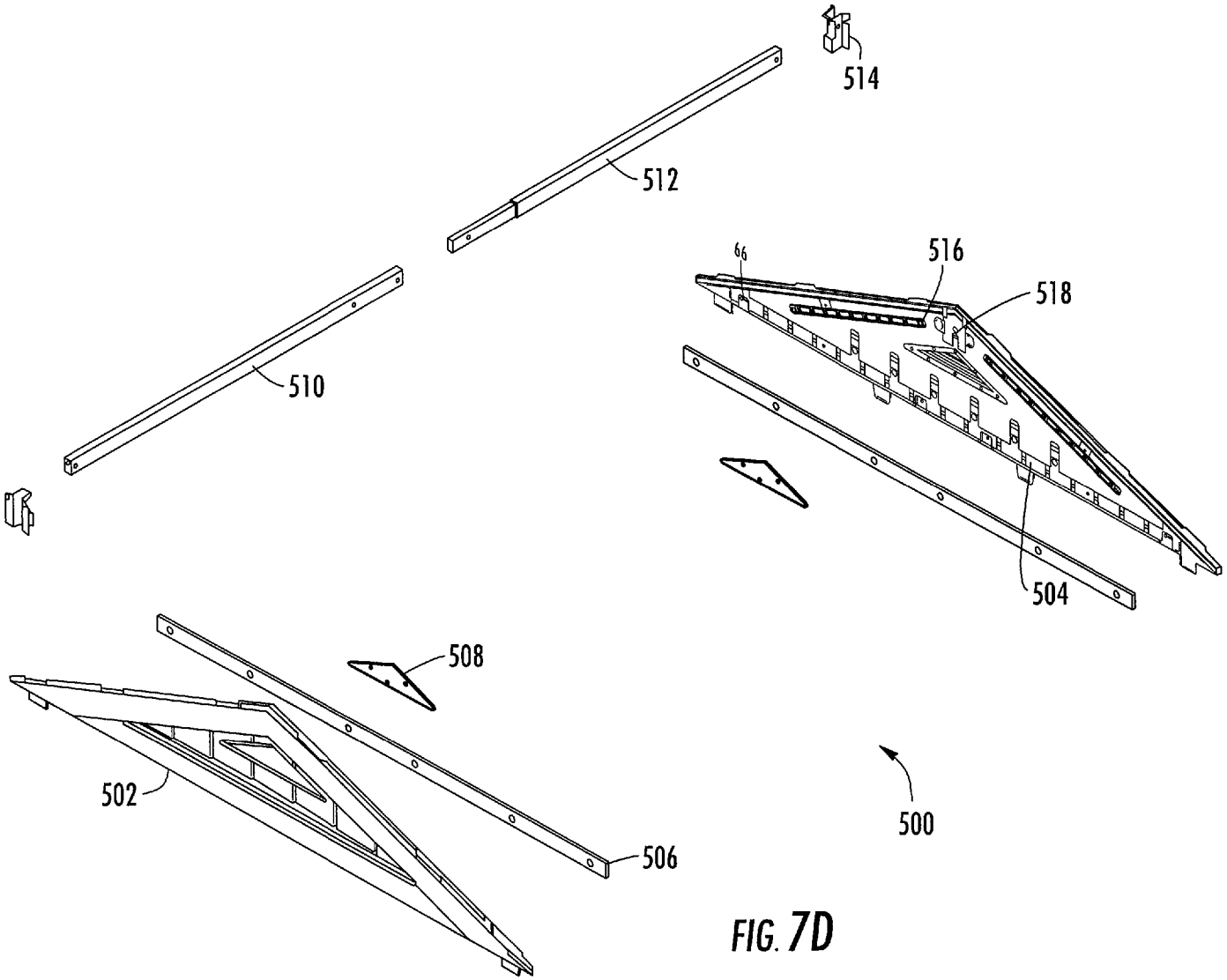
FIG. 7D is an exploded view illustrating the front roof header and the rear roof header of the roof assembly.
Figure 7E:
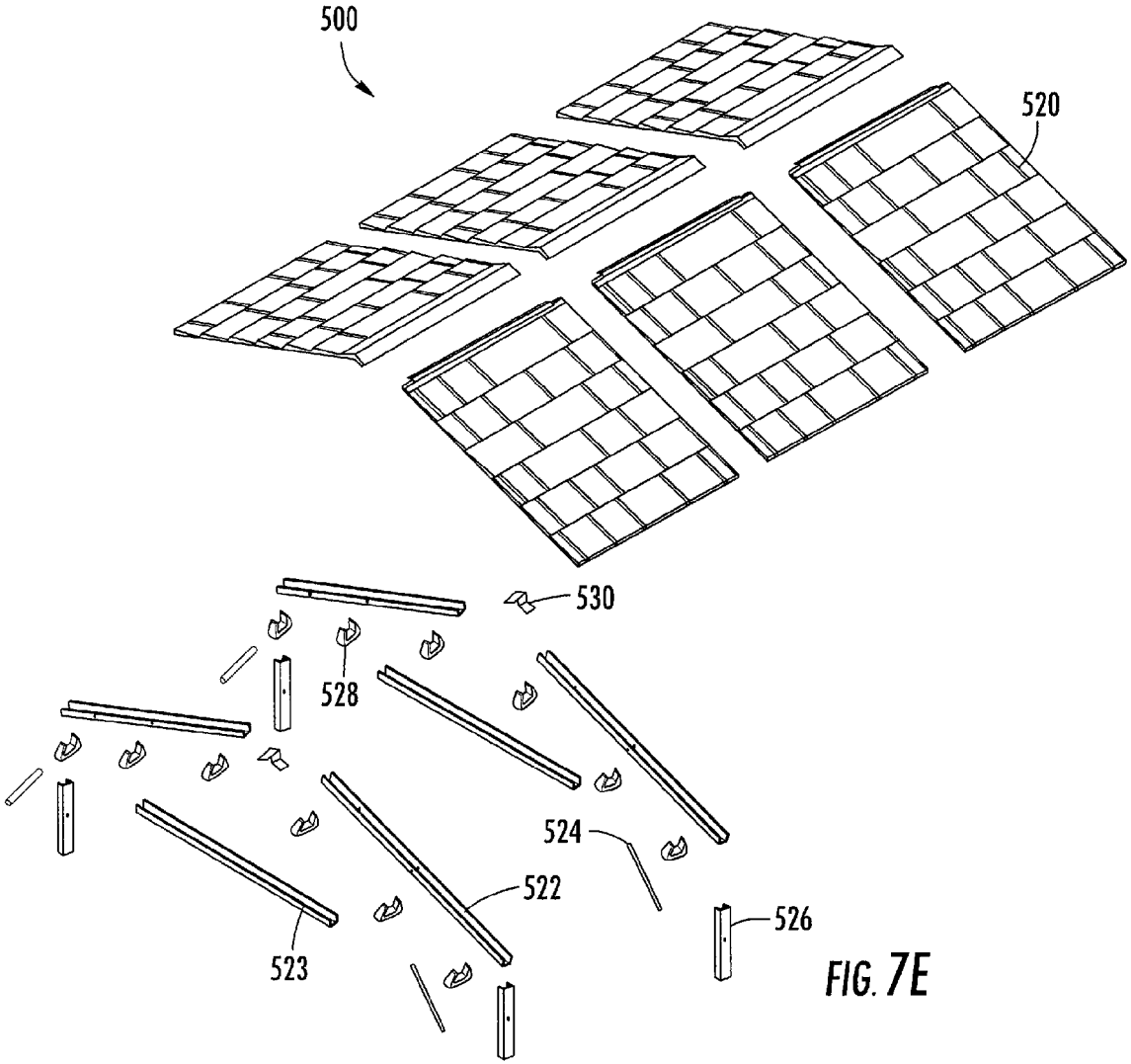
FIG. 7E is an exploded view illustrating the components of one embodiment of the roof assembly.

Referring to FIGS. 7D and 7E, the roof assembly 500 is illustrated. The roof assembly includes a front header 502 and a rear header 504. The front header 502 and a rear header 504 include a header beam 506 and vents 508. Secured to portions of the front header 502 and a rear header 504 are a ridge beam 510 and, if needed, a ridge beam extension 512 using a roof ridge beam bracket 514. Positioned on the interior surface 516 is a slide roof beam bracket receiving area 518 constructed and arranged for attachment and securing of a slide roof beam bracket 514. While the header is preferably triangular in shape to provide extended roof space and prevent debris, rainwater, and snow from accumulating, or provide storage space in conjunction with the rear wall assembly and truss system, the shape is illustrative only. Securing to the roof ridge beam 510 is a plurality of like-constructed roof panels 520. See FIG. 7E. A roof truss assembly, including truss legs 522, truss cross braces 523, straps 524, tie downs 526, truss connectors 528, and truss brackets 530 are used to provide support for the roof panels 520.

Figure 7F:
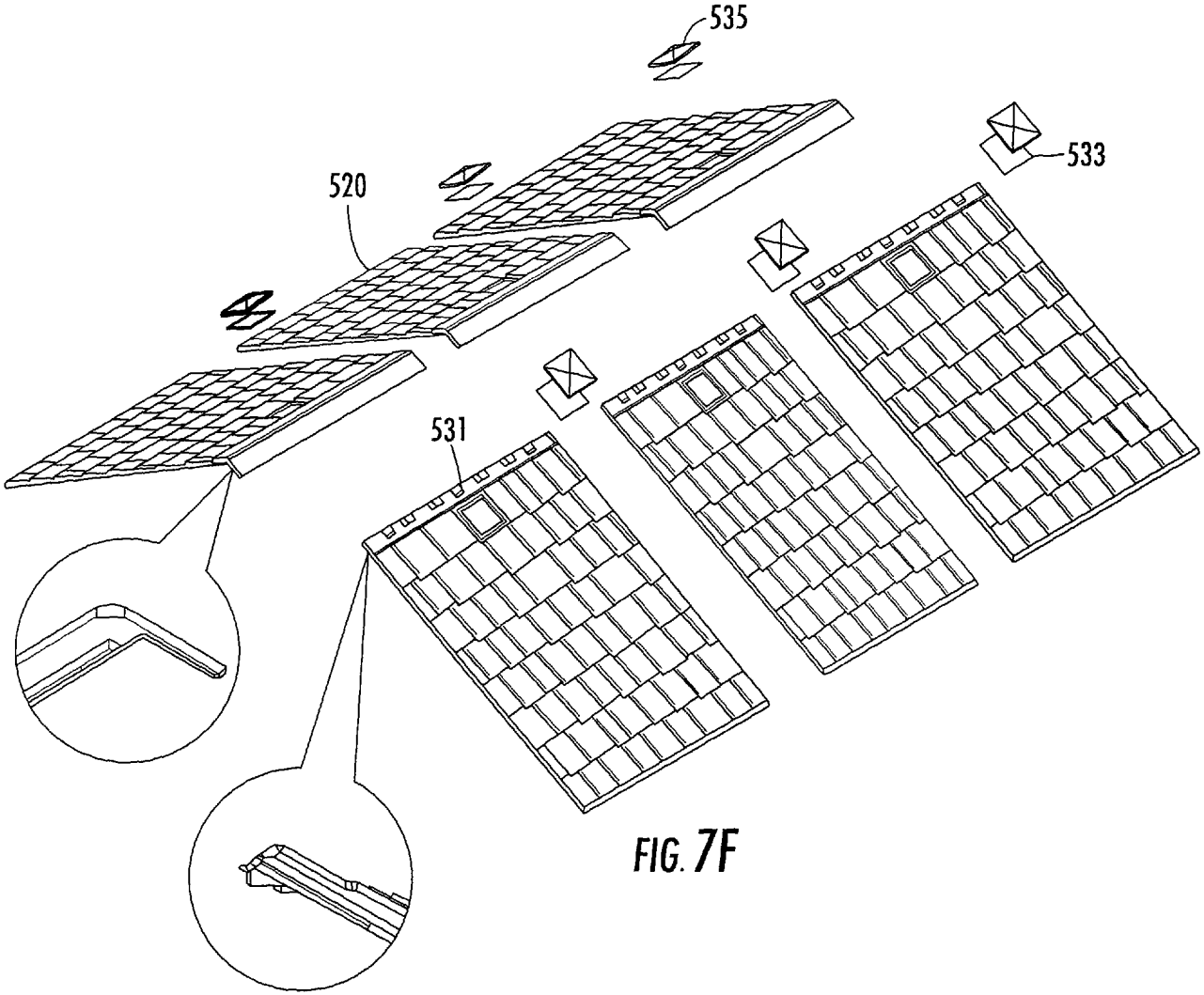
FIG. 7F illustrates a roofing assembly having roof panels with skylights.

FIG. 7F illustrates a roof assembly having roof panels 520 with a skylight aperture 531 sized and shaped to receive and hold a skylight sealing gasket 533 and skylight or light transmitting fenestration 535. While the skylight is preferably made of translucent or transparent glass, other materials for transmitting light, such as plastic or plastic glazing infill, known to one of skill can be used. The skylight connection was designed with a standing rib on the roof panel 502 compressing the gasket into the injection molded skylight. If assembled incorrectly and water was able to get through the gasket, a secondary taller rib on the roof panel is included to prevent water from spilling in through skylight aperture 531.

Figure 7G:
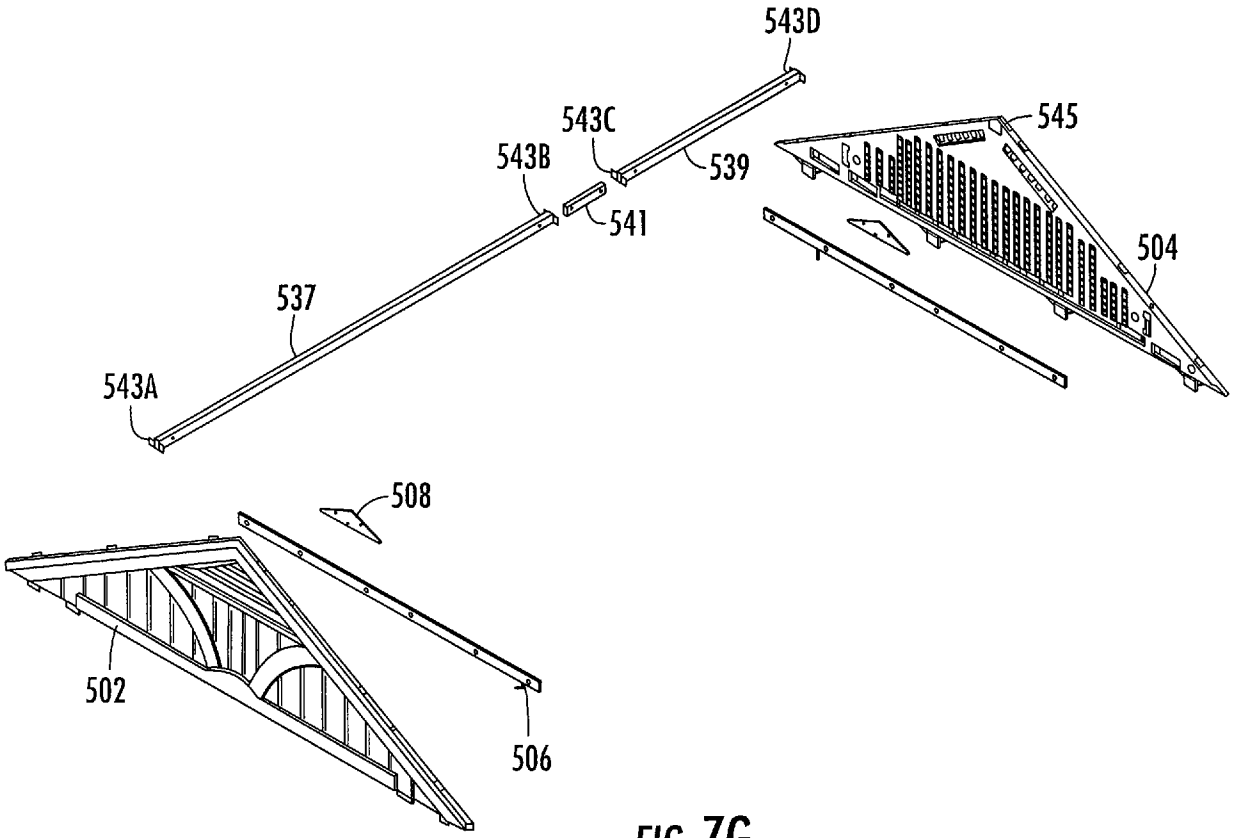
FIG. 7G illustrates a pair of headers which use an alternative ridge beam design.

Referring to FIG. 7G, an alternative ridge beam design is illustrated. In this embodiment, headers 502 and 504 are separated by one or more ridge beams, illustrated as a large ridge beam 537 and a smaller ridge beam 539 connected together by a ridge beam joiner 541. Each ridge beam 537 and 539 contains flanged ends 543A, 543B, 543C, and 543D. The flanged ends 543A, 543B, 543C, and 543D allow for direct attachment to the headers 502 and 504 through a flanged beam receiving area 545 without the use of a metal bracket. Preferably, the ridge beam 537 and 539 (or ridge beam 510 and extender 512) is made of steel. However, all ridge beams may be made of another material.

Figures 10A, 10B, 10C, 10D, 10E:
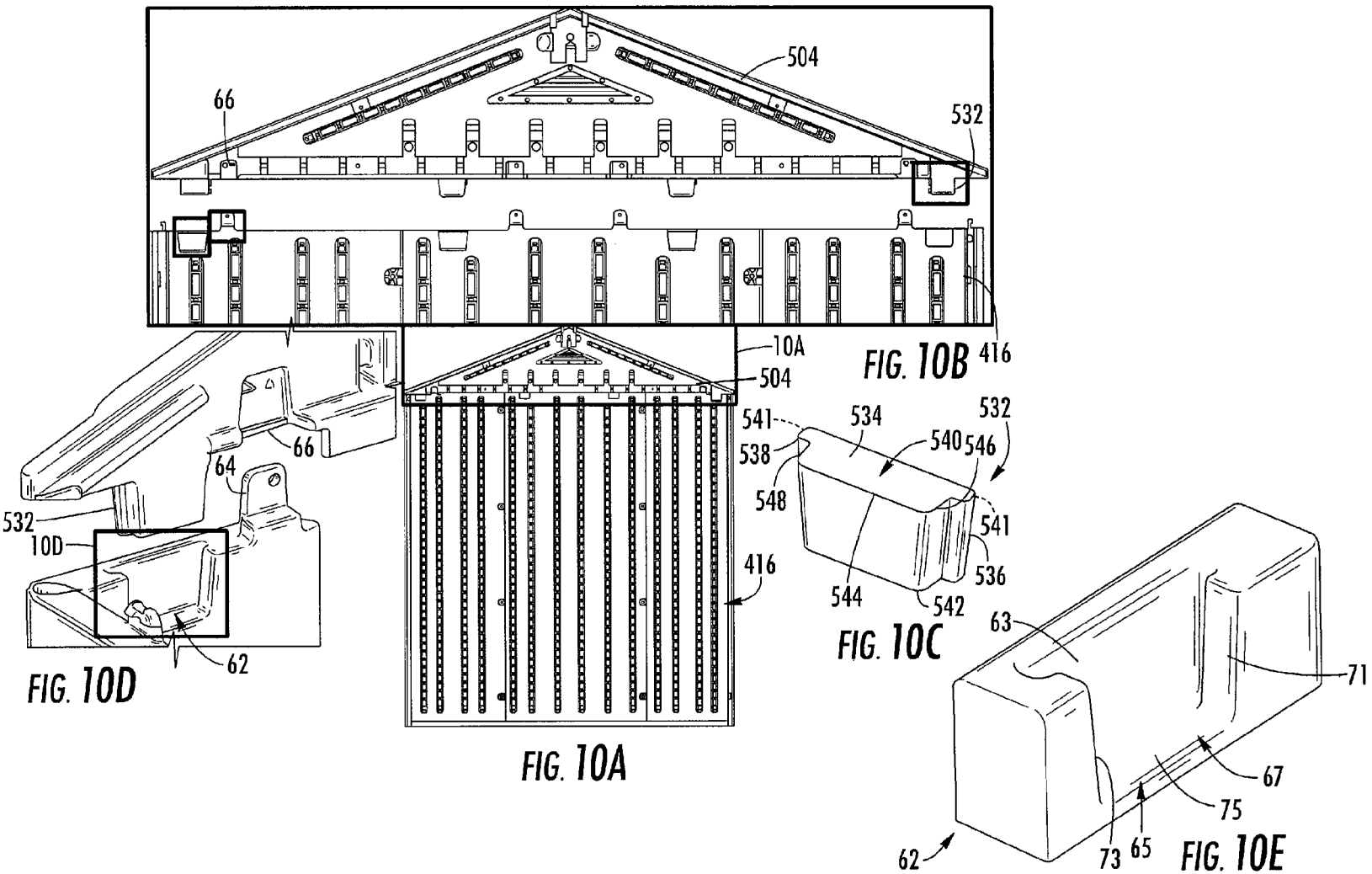
FIG. 10A illustrates an illustrative example of the rear wall panel attached to a header, and attachment of the rear header to a rear wall structure.
FIG. 10B illustrates a partial view taken from Box 10A of FIG. 10A, illustrating the header and top portion of the rear wall.
FIG. 10C is a perspective view of a header connector.
FIG. 10D is an exploded partial view of the connection between the header connector and the self-centering head connector mating receptacle.
FIG. 10E is a perspective view of the self-centering head connector mating receptacle illustrated in Box 10D of FIG. 10D.
Figures 10F, 10G, 10H, 10I:
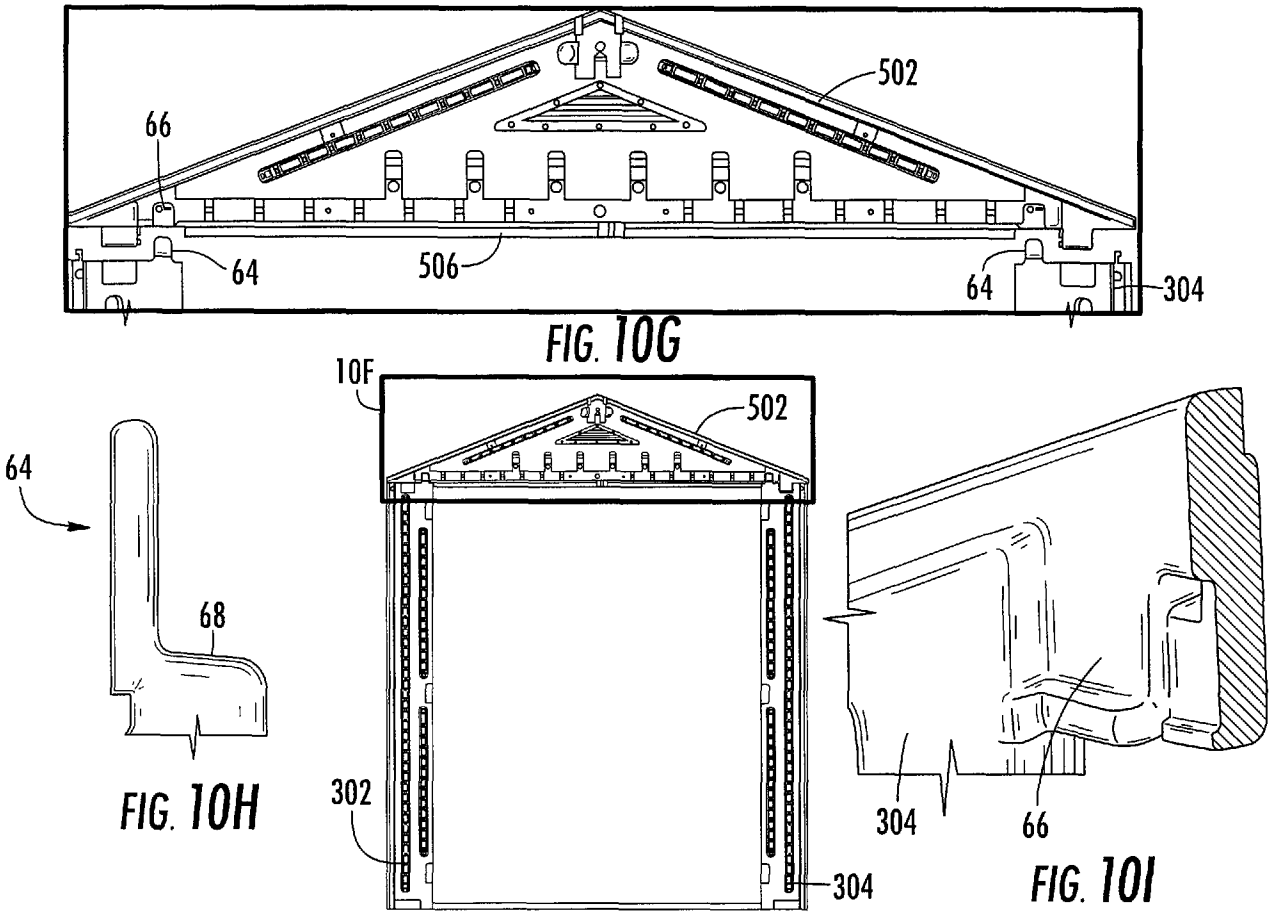
FIG. 10F is a partial view showing the connection between front header and the front corner panel.
FIG. 10G is a partial exploded view taken from Box 10G of FIG. 10F.
FIG. 10H is a side view of a second header-panel connector.
FIG. 10I illustrates a second header-panel receptacle.

To provide for securing of at least a portion of the roof assembly 500 to portions of one or more panels of the modular storage shed 10, the front header 502 or the rear header 504 may be held in place about the shed 10 by one or more integrally formed connectors, illustrated herein as molded header connector 532, see FIGS. 10A-10E. The molded header connector 532 is designed to slide into the integrally formed self-centering head connector mating receptacle 62 contained within the connecting molded panels. As shown in FIG. 10A, 10B or 10D, the integrally formed self-centering head connector mating receptacle 62 is integrally formed to the rear wall 416.

As shown in FIG. 10B, the rear header 504 contains four molded header connectors 532 extending off the panel base into the top of the respective rear panel 416. The front molded header is held in place about the shed by molded header connector 532 slid in mating integrally formed self-centering head connector mating receptacle 62 within the front corner panels 302 and 304 as described above. Referring to FIG. 10C, the header connector 532 comprises a main body 534 separating a plurality of tab members 536 and 538 positioned on opposing sides of the main body and protruding out along a longitudinal axis 540. Each tab member 536 and 538 spans the distance between the upper most surface 540 of the header connector 532 and the lower most surface 542 of the header connector 532. As shown, the plurality of tab members 536 and 538 are set back from a header connector mating receptacle contacting surface 544. The main body 534 preferably has a plurality of angled surfaces 546 and 548.

The self-centering head connector mating receptacle 62 comprises a first receiving area 63 configured to receive the plurality of tab members 536 and 538. As illustrated, the first receiving area 63 has an elongated, slot like shape corresponding to the shape of a portion of the header connector main body 534. The self-centering head connector mating receptacle 62 further comprises a second receiving area 65 for receiving a corresponding shape of the header connector main body 534. The second receiving area 65 has an open space 67 defined by two opposing surfaces 71 and 73 connected by surface 75, thereby forming a generally U-shape. The two opposing surfaces 71 and 73 are preferably angled or inclined, which provides for self-centering and/or guiding of portions of the header connector 532. The angled surfaces further provide for an upper region (furthest from bottom of the U-shape) which is larger than a lower region (closer to bottom of U-shape).

The modular blow molded shed 10 may also contain, at each corner, a corner panel having an extended male tab 64 extending above the top of the panel which will align flush with the extended male tab header receptacle 66, see FIGS. 10B and FIGS. 10G-10I, once slid fully in place. Extended male tab 64 aligns flush with the extended male tab header receptacle 66, which has a molded ledge 68 to prevent the panel from easily disconnecting. Once the panels are assembled, the metal beam 506 and fasteners further hold the structures in place.

Figure 11B:
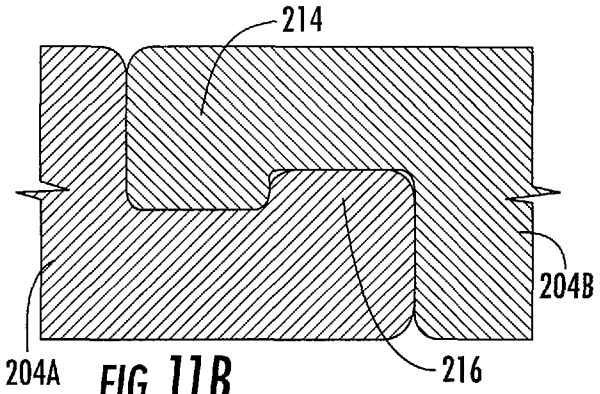
FIG. 11B illustrates normal panel overlap.
Figure 11C:
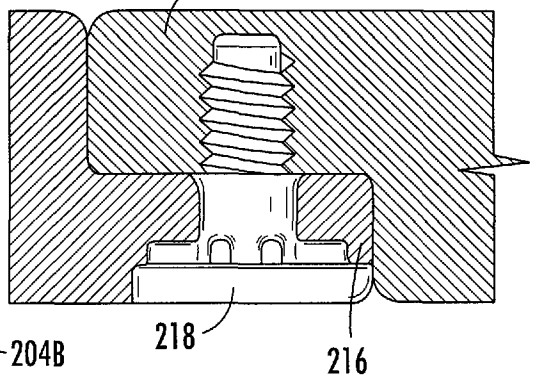
FIG. 11C illustrates panel overlap with an easy bolt connection.

The modular storage shed 10 may contain, at each wall panel, a specially designed overlap feature which acts to hold the panels together and form a water resistance for the shed interior. The overlap also acts to impede other foreign debris from entering the shed. The panel overlap at the easy bolt connection is designed to support a separate injection molded fastener (FIG. 11).

Figure 11A:
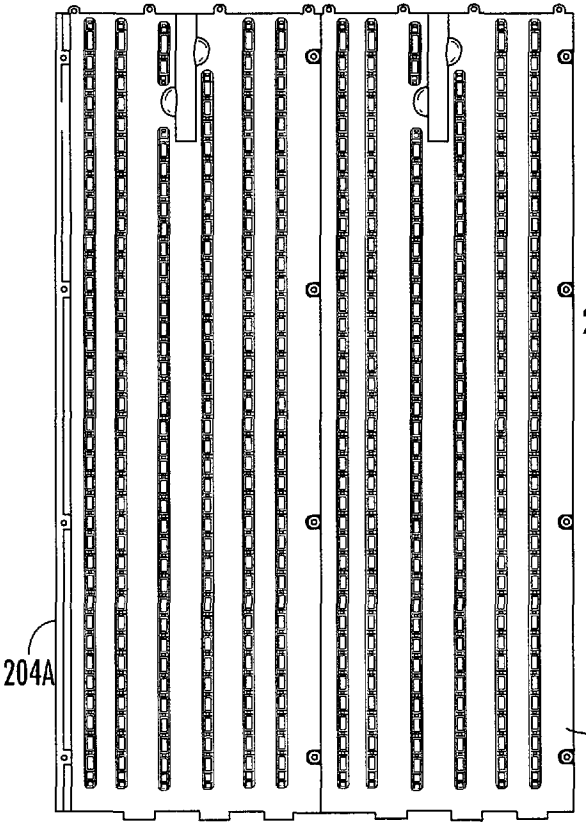
FIG. 11A is an isolated view of panel overlap.
Figure 12A:
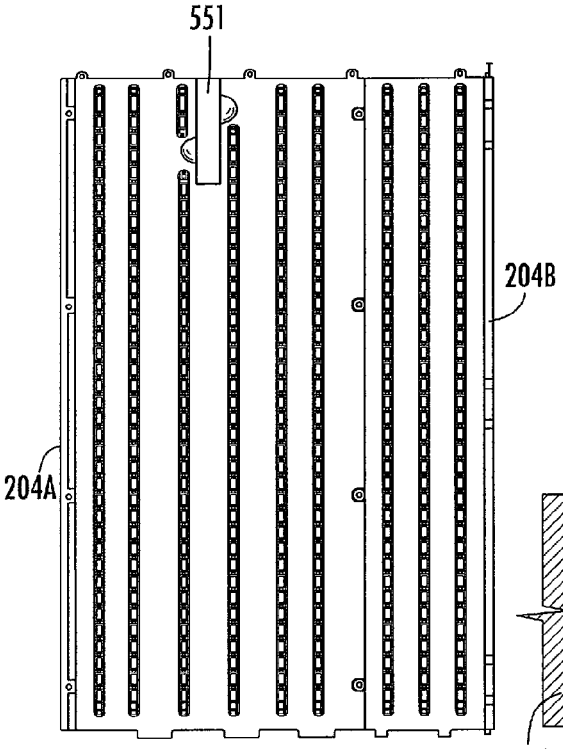
FIG. 12A illustrates connection of panels with the easy bolt.
Figure 12B:
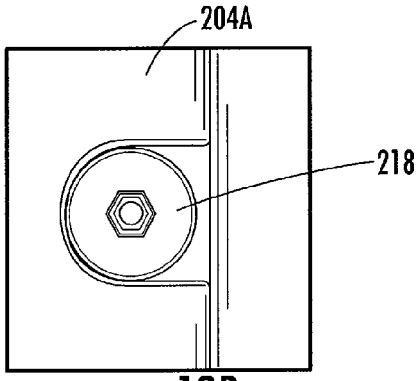
FIG. 12B is a detail view of the easy bolt connection.
Figure 12C:
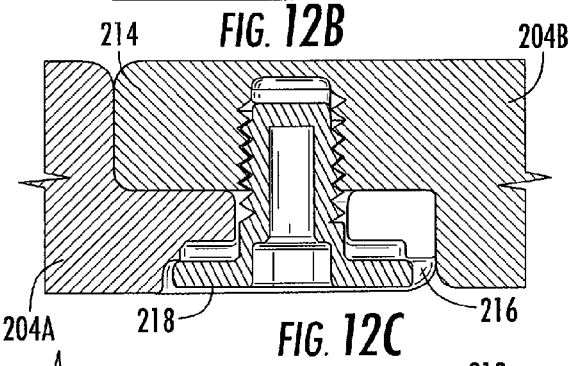
FIG. 12C is a section view of the connection.
Figure 12D:
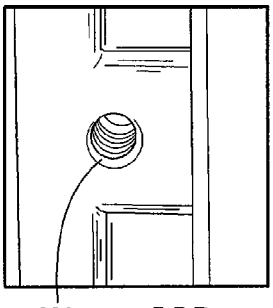
FIG. 12D illustrates a threaded side of a panel.
Figure 12E:
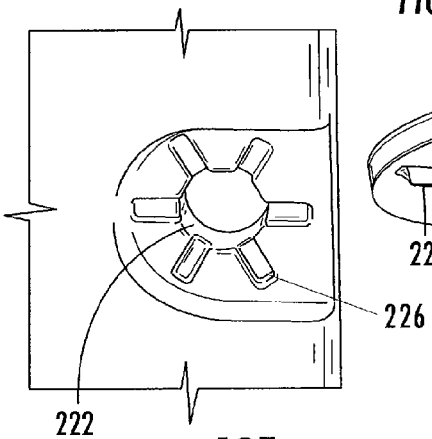
FIG. 12E illustrates a through hole of a panel, showing locking ribs.
Figure 12F:
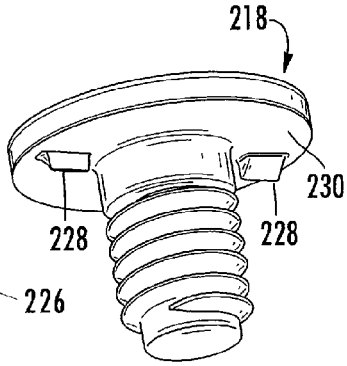
FIG. 12F is a perspective view of an easy bolt connector having a triangle shaped locking feature on the underside.
Figure 13C:
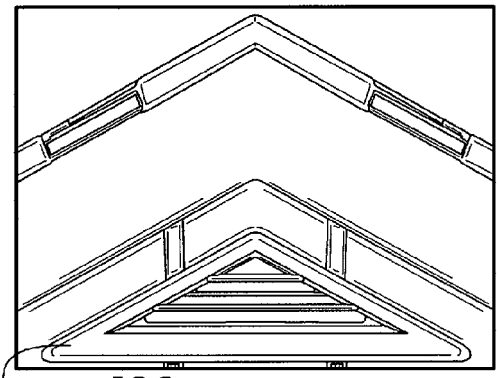
FIG. 13C shows the front view of the vent.
Figure 13D:
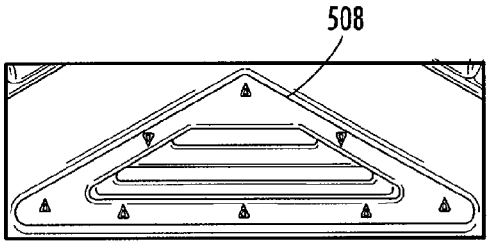
FIG. 13D shows an interior view of the vent.
Figure 13E:
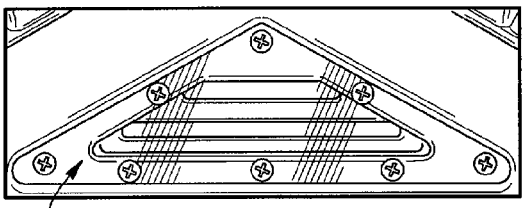
FIG. 13E shows a fiberglass mesh held in place with screws.
Figure 13A:
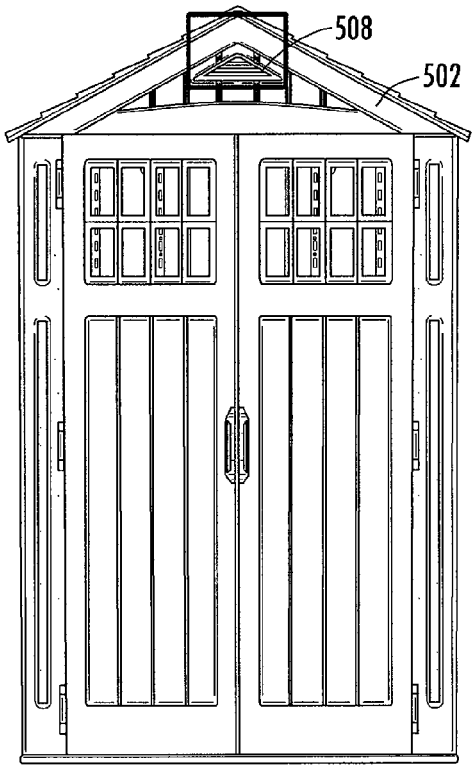
FIG. 13A shows a front view of a panel showing vents.
Figure 13B:
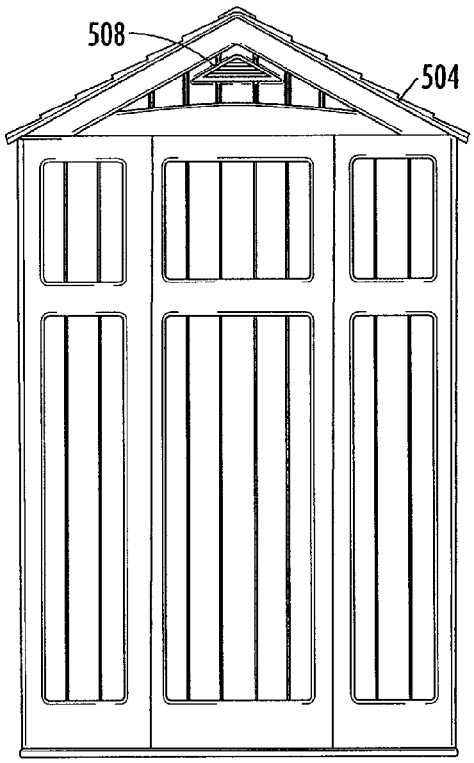
FIG. 13B is a rear view of a panel showing vents.
Figure 14A:
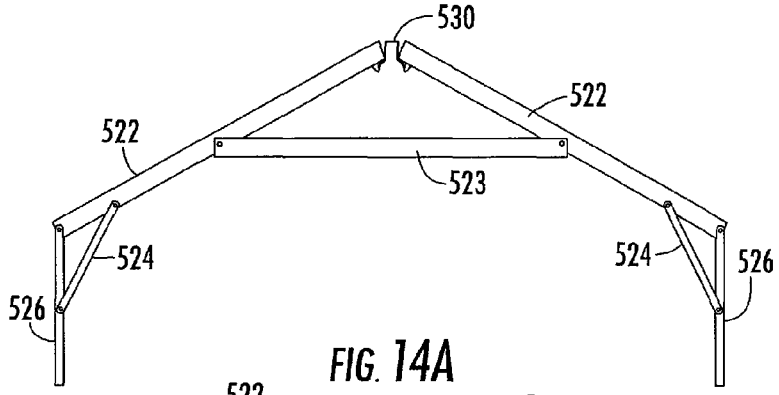
FIG. 14A shows a frame truss system with support straps.
Figure 14B:
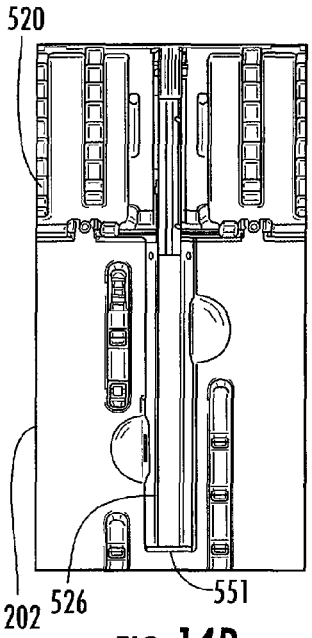
FIG. 14B is an interior view of the shed showing a connection to a side panel.
Figure 14C:
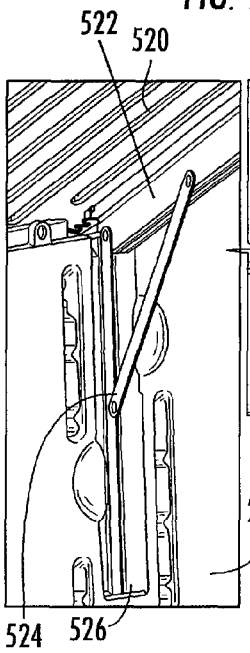
FIG. 14C is an alternate interior view.
Figure 14D:
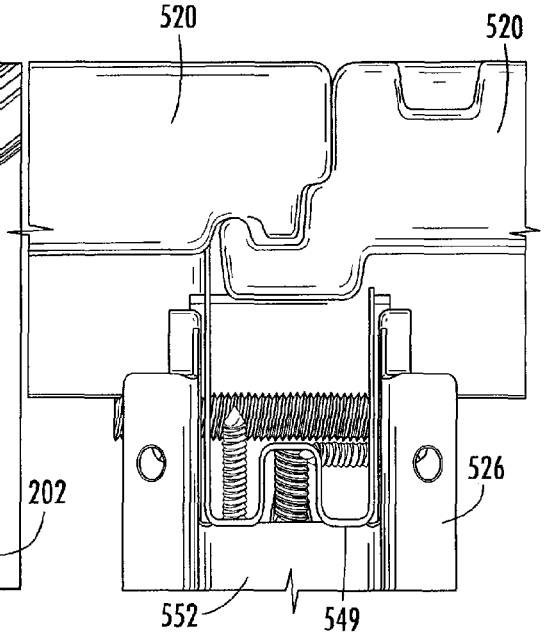
FIG. 14D is an end view showing connection to a roof support.

The modular storage shed 10 can be designed to provide for wall panel overlap sections with easy bolt connections. FIG. 11A illustrates two side walls 204A and 204B connected together. Both side walls have flanged or overhang portions 214 and 216 extending from corresponding side edges 206 and 208, see also FIG. 11B. The side wall overhang portions 214 and 216 may contain curvature so that the two panels secure together, the connection (one overhang portion for a side wall panel secures to a corresponding overhang portion of an adjacent side wall panel) forms an S-shape in cross section. While the overhang portions 214 and 216 are illustrated for side walls, such features can be integrally formed to other panel members, i.e. panels for the front and rear wall panels.

The separate injection molded easy bolt connector 218 is used to secure the mating panels, see FIG. 11C-12F. The easy bolt connector 218 is inserted in the through opening 222 portion of the panel overlap then tightened in the threaded portion 220 of the mating panel. The through opening 222 may also contain locking ribs 226 that are sized and shaped to hold and secure the triangular shaped locking feature 228 located on the underside 230 of the easy bolt connector 218. A positive water resistant seal is held consistent from the floor to the top of the blow molded panel by holding the panels with a plurality of connectors, see FIG. 12A-12F.

The modular resin storage shed 10 may contain, located at the front and rear upper portion of the header, a molded-in decorative vent 508 that allows air passage throughout the shed. The vent serves both decorative and functional roles. Attached to the interior of each header panel is a mesh screen 550 that is held in place by screws, see FIGS. 13A-13E.

The modular storage shed 10 may contain two frame truss systems, located at the first third of the modular storage shed 10 and second third of shed along the length of the modular storage shed 10. FIGS. 14A-14D illustrate partial views of the truss system attached to side panels and/or roof panels. Separate metal extruded beams are fastened together by bolts and nuts. A separate metal strap 524 is installed to hold the specific roof angle. Metal brackets 549 attach to a truss member receiving channel 551 molded or integrally formed to a panel member, such as a side wall panel member 204A or 204B, see FIG. 7B. At the roof overlap, side wall panels fit within the truss leg 526.

Figure 15A:
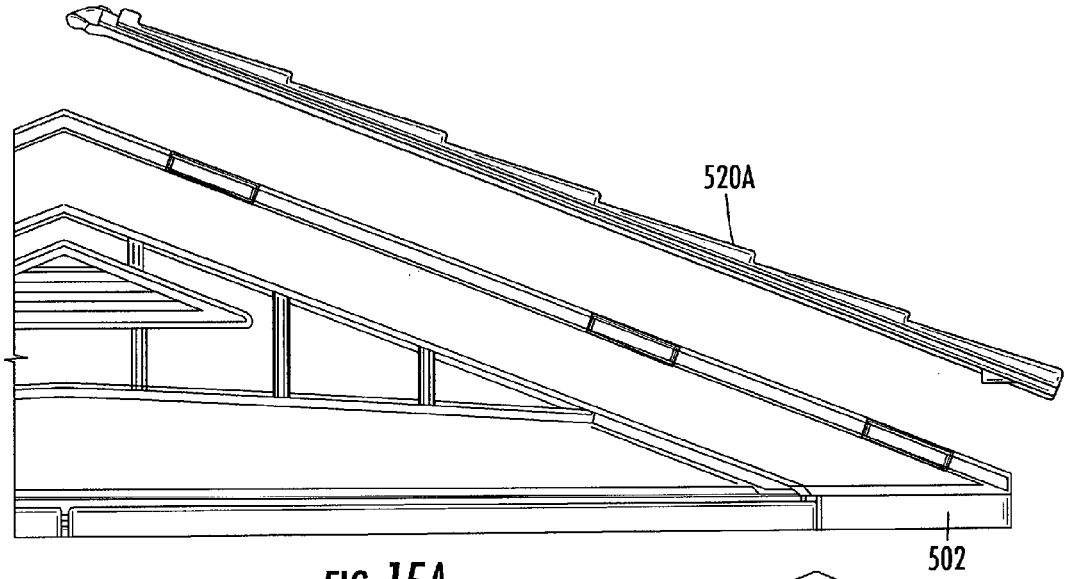
FIG. 15A is a view of the front of the shed showing roof connection to a header.
Figure 15B:
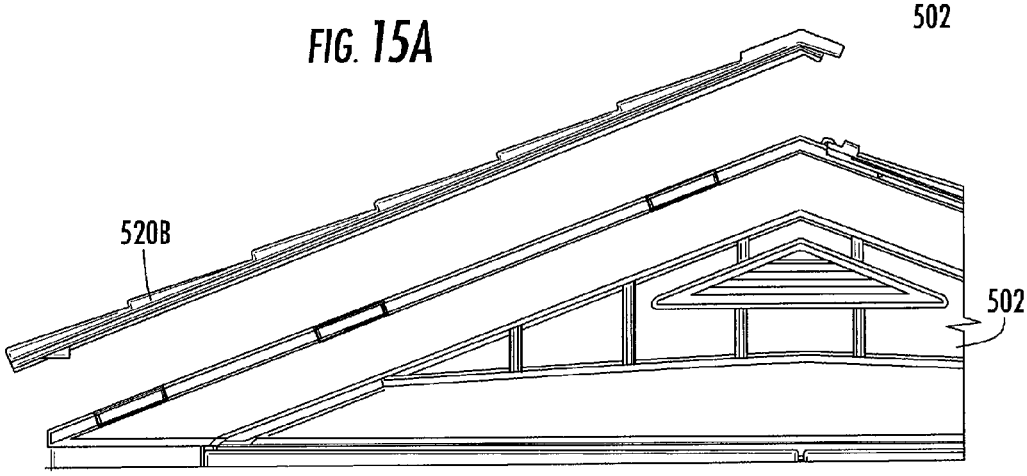
FIG. 15B is a view of the front of the shed showing a second roof connection to a header.
Figure 15C:
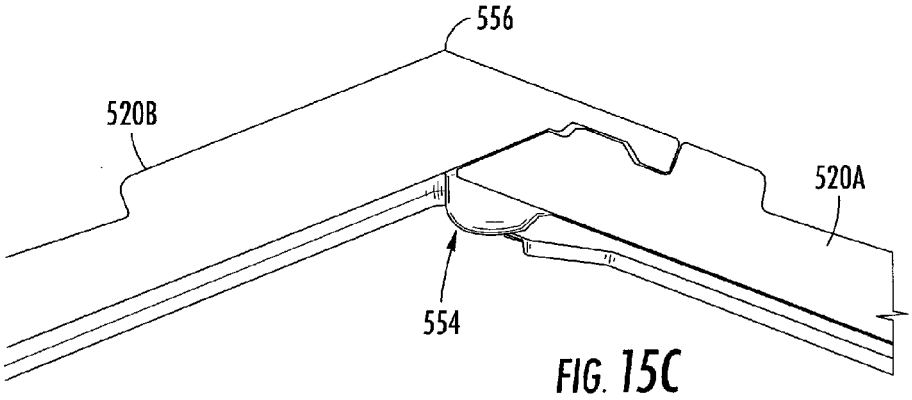
FIG. 15C is a section view of the roof overlap at the peak.
Figure 16A:
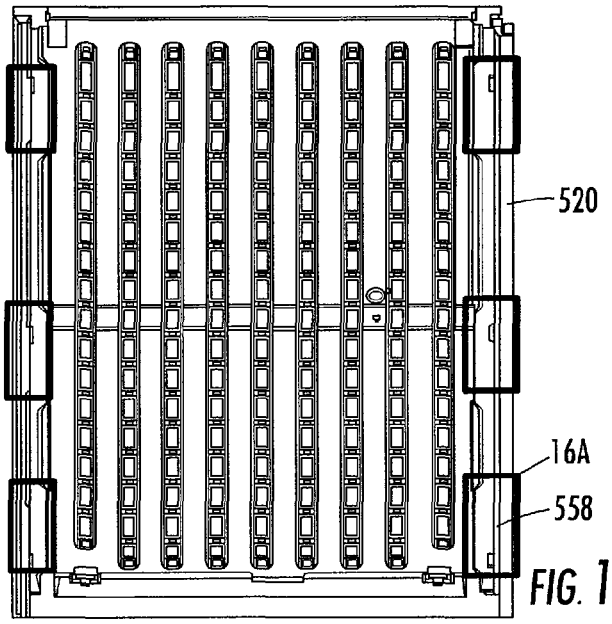
FIG. 16A illustrates the underside of the roof panel.
Figure 16B:
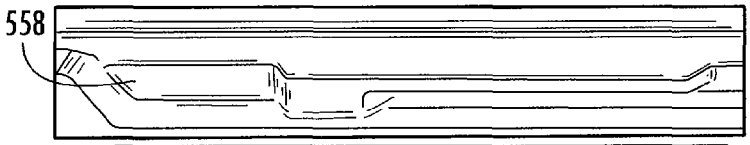
FIG. 16B illustrates a close up view of the roof panel connector tabs.
Figure 16D:
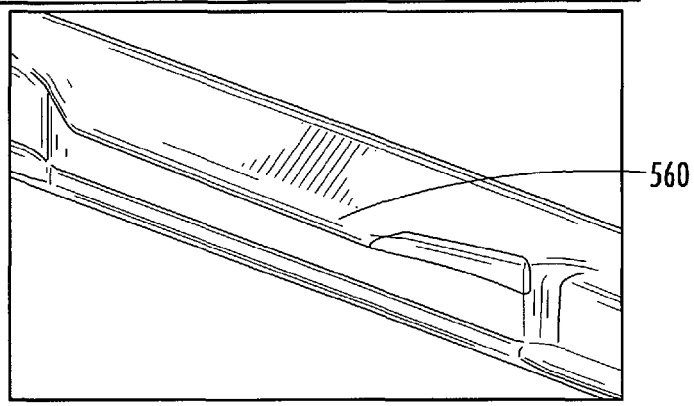
FIG. 16D is a close up view of the header roof panel connector.
Figure 16C:
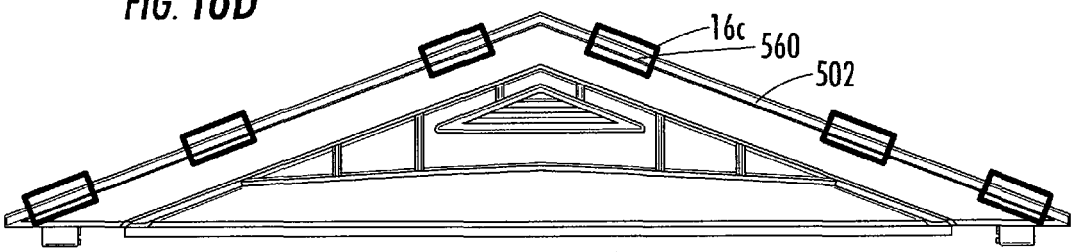
FIG. 16C is a front view of the header, illustrating the header roof panel connector.
Figure 17A:
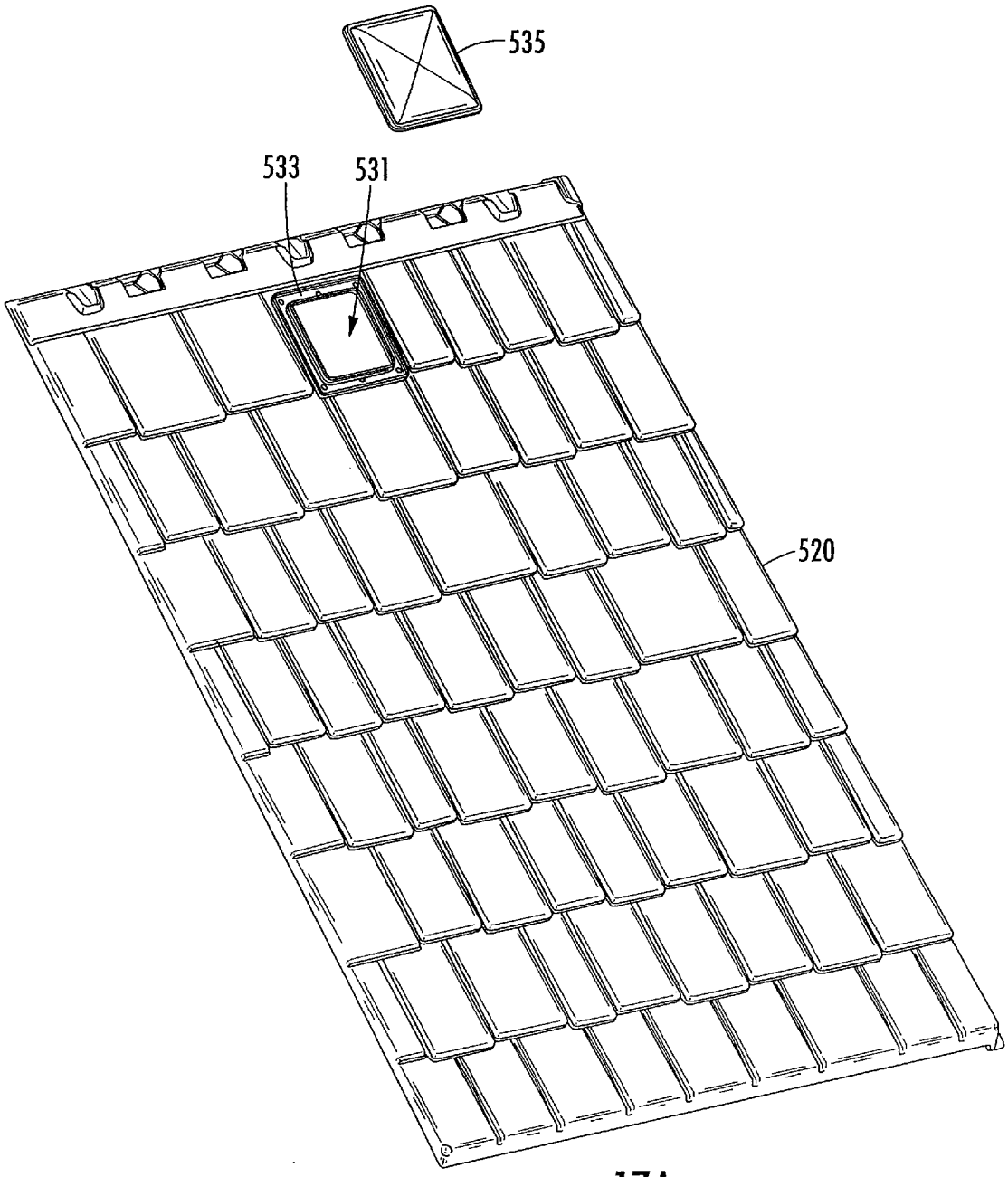
FIG. 17A is a perspective view of an illustrative embodiment of a skylight assembly.
Figure 17B:
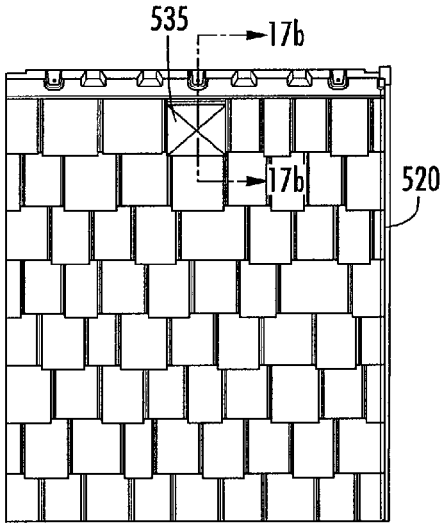
FIG. 17B is a top view of a roof panel with skylight assembly.
Figure 17D:
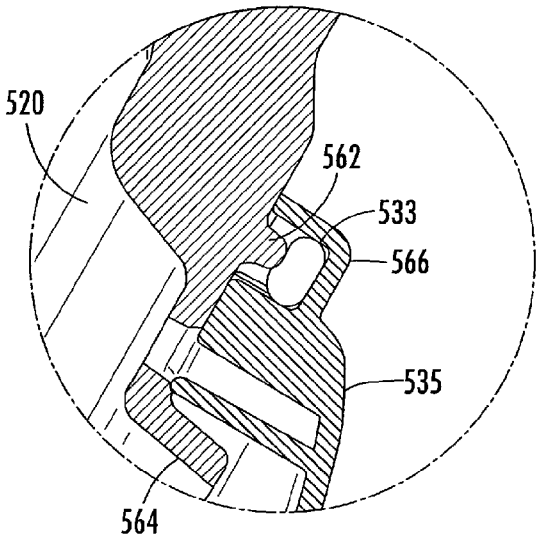
FIG. 17D is an exploded view of 17C-17C in FIG. 17C.
Figure 17C:
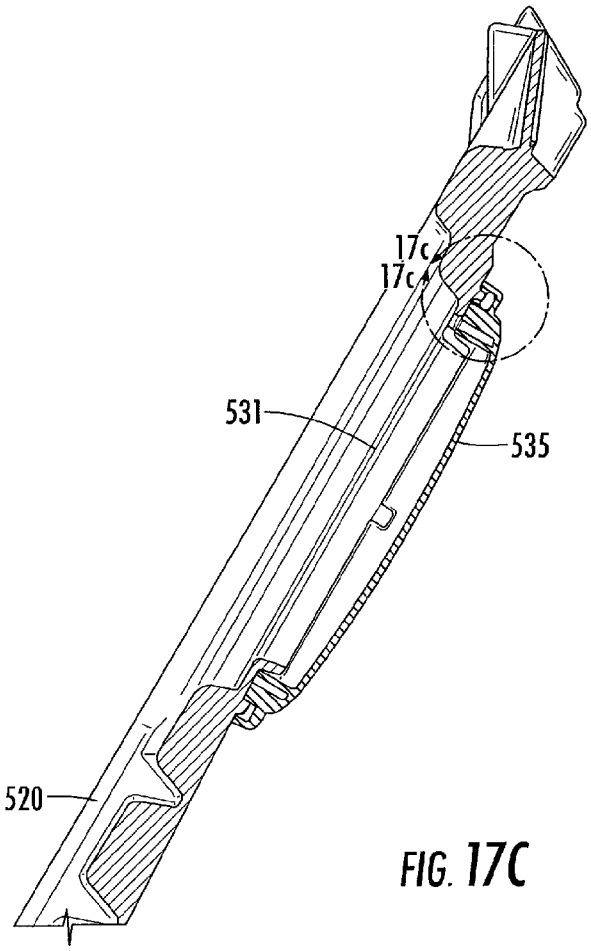
FIG. 17C is a cross sectional view of the skylight assembly in roof panel taken along lines 179-179 of FIG. 17B.
Figure 18A:
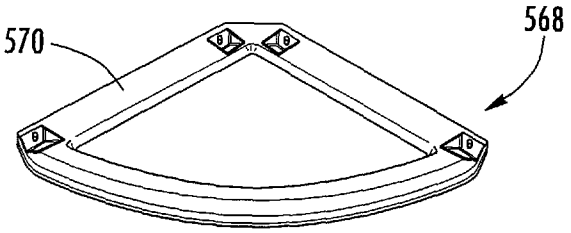
FIG. 18A is an illustrative view of a shelf.
Figure 18B:
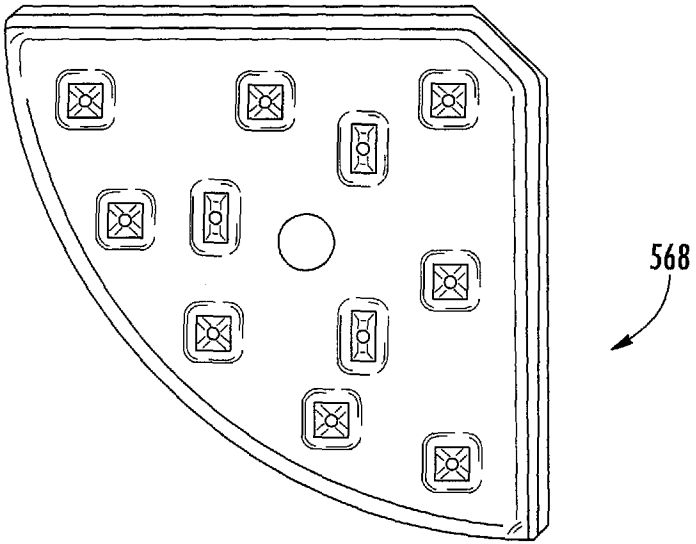
FIG. 18B is an alternative view of the shelf.
Figure 18C:
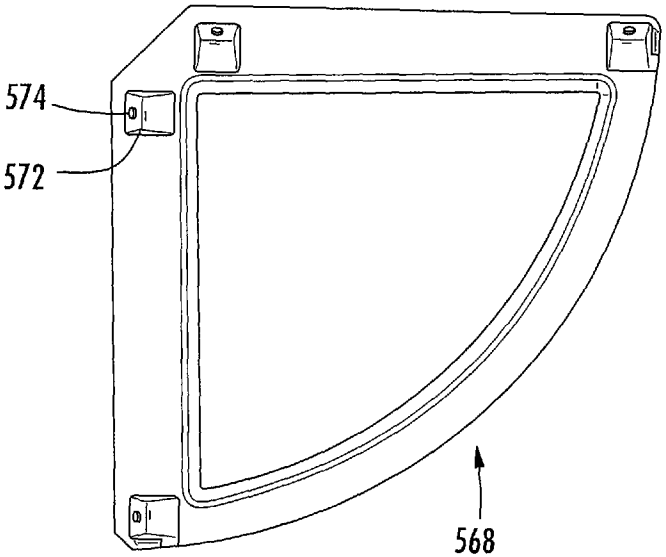
FIG. 18C is an alternative view of the shelf.
Figure 18D:
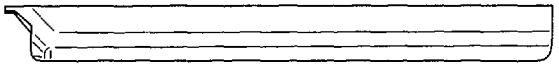
FIG. 18D is an alternative view of the shelf.
Figure 18G:
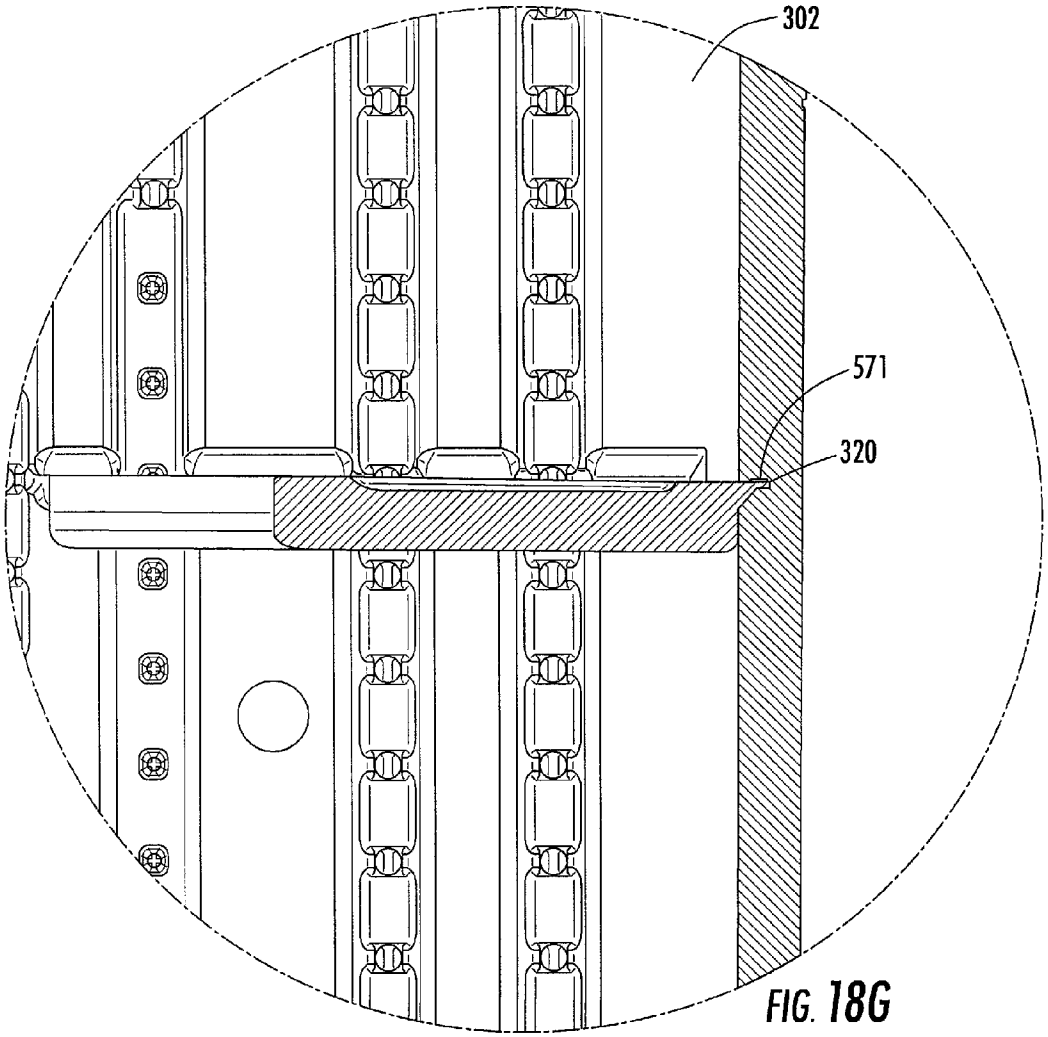
FIG. 18G is a blow up view of 18F-18F illustrated in FIG. 18F.
Figure 18F:
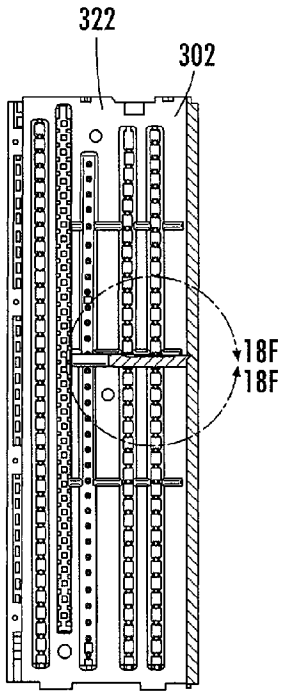
FIG. 18F is a cross sectional view taken along lines 18E-18E in FIG. 18E.
Figure 18E:
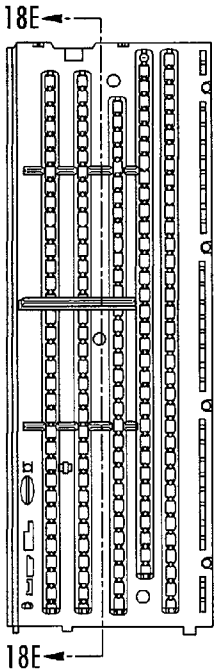
FIG. 18E illustrates a corner panel with shelf.

The modular storage shed 10 may contain roof panels 520 which are attached to the modular storage shed 10 by laying the roof panels in the truss legs channel 552 on one end and snapped to the header 502 at the other end, see FIGS. 15A-15C. A water resistant overlap 554 is formed at the peak of the unit 556.

The overlap 554 also impedes foreign debris from entering the shed and forms an even seam along the length of the shed roof. The modular storage shed 10 may contain channels 558 on the underside of each roof panel 520 to allow the panel 520 to be attached at the front and rear of the unit, interchangeably. Male protruding header roof panel connector tabs 560 on headers 502, 504 attach to common ledges at specific locations. Roof panels 520 are attached to header panels 502, 504 by first holding the roof panel 520 at the correct angle, and then applying pressure at the overlapping ledge and protruding tab overlap, see FIGS. 16A-16D. With the roof channels 558 seated over the header roof panel connector tabs 560, the roof panel 520 is pulled downward at each header roof panel connector tab 560 until the roof panel 520 snaps in place. The header roof panel connector tabs may be further secured using securing screws.

FIGS. 17A-17D illustrate an embodiment of a roof panel 520 having a skylight 535. The design of the skylight assembly was for the purpose of allowing light in while keeping water out. The skylight assembly connection was engineered so that a standing rib 562 on the roof panel 520 compresses the gasket 533 into the injection molded skylight. If assembled incorrectly and water was able to get through the gasket, a secondary taller rib 564 on the roof panel prevents water from spilling in through the large cut-out opening 531 in the roof. As such, a portion of the skylight 535 rests between roof panel ribs 562 and 564. The skylight 535 compromises an open takeoff 566 which is positioned over the standing rib 562.

The modular storage shed 10 may also include one or more corner shelves 568 designed to fit into any of the 4 corners, see FIGS. 18A-F. To accommodate the shelves, the corner panels 302 may have a small horizontal slit 320 that tack-off on the inner surface 322 or cavity side to provide strength and support for the shelves. The corner shelves 568 have a molded compressed lip 570 that fits into the corner panel 302 tack off, illustrated herein as a panel shelf receiving area 571. Such region further provides support for the shelf when supporting weighted objects. Each shelf 568 has multiple areas where plastic is compressed to form a thin membrane 572 that will allow a screw 574 to go through for assembly. The attachment method is strictly to hold the shelf in place, as the compressed lip and the overall thickness of the shelf panel itself provide the rigidity. As the shelf is loaded, it naturally will "kick" into the corner panel. The compressed lip will hit the return wall, preventing it from falling.

The present invention further contemplates a kit for providing an enclosure, such as a modular blow molded shed comprising one or more of any component as described herein.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A modular utility shed construction system utilizing blow molded plastic structural panels having integrally formed blow molded connectors comprising:

a floor assembly for forming a bottom of a utility shed, said floor assembly including at least one floor panel member having one or more integrally formed snap connector mating receptacle constructed to receive and secure therein a snap connector associated with one or more members of a side wall assembly, a front wall assembly, or a rear wall assembly;

a pair of side wall assemblies for enclosing the left side and right side of said utility shed, said pair of side wall assemblies including at least one side wall panel member secured to said at least one floor panel member;

a front wall assembly for enclosing the front of said utility shed, said front wall assembly including one or more front wall panels secured to said at least one floor panel member, at least one of said one or more front wall panels comprising an integrally formed snap connector;

a rear wall assembly for enclosing the back of said utility shed, said rear wall assembly including one or more rear wall panels secured to said at least one floor panel member, at least one of said one or more rear wall panels comprising an integrally formed snap connector;

each snap connector comprising a body extending away from a bottom surface of said front wall panel or said rear wall panel and integrally formed thereto, said body comprising a first wall having a vertical potion terminating in a flange, said flange having a first ramping surface and a locking surface, said body comprising a second opposing wall comprising an angled surface forming a snap connector tip at one end and a vertical overhang portion forming a support surface at an opposing end, said vertical overhang portion parallel with and at a distance from said locking surface; and a roof assembly for enclosing an upper portion of said utility shed, said roof assembly including a plurality of frame members secured together and fastened to said pair of side wall assemblies to form roof truss and a plurality of roof panels secured to said roof truss.

2. The modular utility shed construction system utilizing blow molded plastic structural panels having integrally formed blow molded connectors according to claim 1 wherein said snap connector comprises a J shape configuration in cross section.

3. The modular utility shed construction system utilizing blow molded plastic structural panels having integrally formed blow molded connectors according to claim 1 wherein said snap connector mating receptacle comprises a shoulder abutting at least a portion of said snap connector locking surface when inserted therein and sized and shaped to maintain said locking surface in place.

4. The modular utility shed construction system utilizing blow molded plastic structural panels having integrally formed blow molded connectors according to claim 1 wherein members of said side wall assembly, said front wall assembly, or said rear wall assembly comprise at least one second integrally formed connector, said second integrally formed connector differing from said integrally formed snap connector.

5. The modular utility shed construction system utilizing blow molded plastic structural panels having integrally formed blow molded connectors according to claim 4 wherein said second integrally formed connector is a foot connector configured to slideably cooperate with an integrally formed foot connector mating receptacle.

6. The modular utility shed construction system utilizing blow molded plastic structural panels having integrally formed blow molded connectors according to claim 1 wherein said floor panel assembly further includes at least one second integrally formed connector mating receptacle, said at least one second integrally formed connector mating receptacle being different than said integrally formed snap connector mating receptacle and configured to slideably cooperate with a plurality of second connectors located on each of said opposing side wall assemblies, front wall assemblies, rear wall assemblies, or combinations thereof.

7. The modular utility shed construction system utilizing blow molded plastic structural panels having integrally formed blow molded connectors according to claim 1 wherein said roof assembly further includes at least one header having at least one integrally formed connector configured to secure said at least one header to said front assembly or said rear assembly.

8. The modular utility shed construction system utilizing blow molded plastic structural panels having integrally formed blow molded connectors according to claim 1 wherein said front wall assembly includes at least one front wall panel comprising two opposing sides connected by a hinge for securing to two independent surfaces which intersect at an angle.

9. The modular utility shed construction system utilizing blow molded plastic structural panels having integrally formed blow molded connectors according to claim 1 wherein said rear wall assembly includes at least one rear wall panel comprising two opposing sides connected by a hinge for securing to two independent surfaces which intersect at an angle.

10. The modular utility shed construction system utilizing blow molded plastic structural panels having integrally formed blow molded connectors according to claim 1 further including a door assembly for permitting access to said modular utility shed, said door assembly positioned within said front wall assembly.

11. The modular utility shed construction system utilizing blow molded plastic structural panels having integrally formed blow molded connectors according to claim 1 wherein said roof assembly contains at least one metal structure.

12. The modular utility shed construction system utilizing blow molded plastic structural panels having integrally formed blow molded connectors according to claim 1 wherein said floor panel assembly includes two or more floor panel member secured together.

13. The modular utility shed construction system utilizing blow molded plastic structural panels having integrally formed blow molded connectors according to claim 1 wherein said floor assembly includes two or more floor panel members secured together in a substantially juxtaposed, coplanar relationship.

14. The modular utility shed construction system utilizing blow molded plastic structural panels having integrally formed blow molded connectors according to claim 1 wherein said pair of side wall panel assemblies includes at least two side wall panels secured together in a substantially juxtaposed, coplanar relationship.

15. The modular utility shed construction system utilizing blow molded plastic structural panels having integrally formed blow molded connectors according to claim 1 wherein said pair of side wall panel assemblies include at least three side wall panels secured together in a substantially juxtaposed, coplanar relationship.

16. The modular utility shed construction system utilizing blow molded plastic structural panels having integrally formed blow molded connectors according to claim 1 wherein said wall panels contain a flange, said flange constructed and arranged to cooperate with an adjacently positioned wall panel containing a flange, wherein said cooperation results in the formation of a water resistant overlapping connection acting to impede water and other foreign debris from entering the interior of said shed.

17. The modular utility shed construction system utilizing blow molded plastic structural panels having integrally formed blow molded connectors according to claim 16 wherein cooperation of one said wall panel having said flange with an adjacent said wall panel having a flange forms a generally S-shaped configuration when viewed in cross section.

18. The modular utility shed construction system utilizing blow molded plastic structural panels having integrally formed blow molded connectors according to claim 1 wherein said at least one roof panel has at least one skylight.

19. The modular utility shed construction system utilizing blow molded plastic structural panels having integrally formed blow molded connectors according to claim 1 further including shelving.

20. The modular utility shed construction system utilizing blow molded plastic structural panels having integrally formed blow molded connectors according to claim 1 wherein at least one side wall panel member of said side wall assembly includes at least one said snap connector.

* * * * *